US007233765B2

(12) United States Patent
Murai et al.

(10) Patent No.: US 7,233,765 B2
(45) Date of Patent: Jun. 19, 2007

(54) IMAGE FORMING APPARATUS, IMAGE FORMING SYSTEM, AND ELECTROPHOTOGRAPHIC PRINT

(75) Inventors: Ashita Murai, Shizuoka (JP); Kazuhito Miyake, Shizuoka (JP); Hiroshi Nagate, Shizuoka (JP); Hiroshi Ishizuka, Kanagawa (JP); Yoichi Nakamura, Kanagawa (JP); Kenichi Saito, Kanagawa (JP); Hiroaki Nakamura, Kanagawa (JP); Eiichi Kito, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 22 days.

(21) Appl. No.: 10/900,307

(22) Filed: Jul. 28, 2004

(65) Prior Publication Data

US 2005/0025540 A1 Feb. 3, 2005

(30) Foreign Application Priority Data

Jul. 31, 2003 (JP) ..... 2003-204793

(51) Int. Cl.
*G03G 15/20* (2006.01)
*G03G 15/00* (2006.01)

(52) U.S. Cl. ..... 399/341; 399/390

(58) Field of Classification Search ..... 399/341, 399/384, 385, 386, 387, 328, 329, 324, 79, 399/80, 390; 219/216
See application file for complete search history.

(56) References Cited

U.S. PATENT DOCUMENTS 6,172,737 B1 * 1/2001 Yamada ..... 355/29
6,339,692 B2 * 1/2002 Yoshida et al. ..... 399/384
6,571,071 B2 * 5/2003 Kanoshima et al. ..... 399/79
6,771,926 B2 * 8/2004 Ishikawa et al. ..... 399/329

FOREIGN PATENT DOCUMENTS

| | | |
|---|---|---|
| JP | 4-212168 A | 8/1992 |
| JP | 8-211645 A | 8/1996 |
| JP | 2002-258508 A | 9/2002 |

* cited by examiner

*Primary Examiner*—Hoang Ngo
(74) *Attorney, Agent, or Firm*—Sughrue Mion, PLLC

(57) ABSTRACT

An image forming apparatus includes a forming unit configured to form a latent electrostatic image on a latent electrostatic image bearing member based on a digital image; a developing unit configured to develop the latent electrostatic image with a toner to form a visible image; a transferring unit configured to transfer the visible image to one of an electrophotographic image receiving roll and an electrophotographic image receiving sheet; and a smoothing and fixing unit configured to smooth and fix the transferred image on one of the electrophotographic image receiving roll and the electrophotographic image receiving sheet to thereby form a series of electrophotographic prints and an electrophotographic print. In the apparatus, the hardware including the media, printer and unit for aftertreatment optimally matches with the toner, and the apparatus can produce high-quality images equal to silver-halide photographs.

28 Claims, 6 Drawing Sheets

IMAGE FORMING APPARATUS, IMAGE FORMING SYSTEM, AND ELECTROPHOTOGRAPHIC PRINT

BACKGROUND OF THE INVENTION

1. Field of the Invention

The present invention relates to an electrophotographic image forming apparatus, an image forming system and an electrophotographic print which provide image quality equivalent to silver-halide photographic prints.

2. Description of the Related Art

According to electrophotography, a latent electrostatic image is formed on a latent electrostatic image bearing member (photoconductor) by the action of photoconduction, and charged colored fine particles (toner) are applied to the latent electrostatic image by the action of electrostatic force to thereby form a visible image. Various attempts have been made in the electrophotography to produce high-quality images that are equal to silver-halide photographic prints. Japanese Patent Application Laid-Open (JP-A) No. 04-212168, No. 08-211645 and No. 2002-258508 each propose an electrophotographic image-receiving sheet using a highly glossy dedicated paper.

However, such conventional technologies do not yet realize high image quality that is equal to silver-halide photographs (photographic image quality in its real meaning), because hardware such as a medium (electrophotographic image receiving sheet), a printer (image forming apparatus) and a unit for aftertreatment such as smoothing and glossing does not optimally match with a toner to be used.

As the silver-halide photographic prints, an electrophotographic print having substantially an entire surface thereof formed with a toner image is preferred (hereinafter referred to as "borderless print" as the case may be). In contrast, electrophotographic prints are generally formed not as borderless prints but as prints having margins of several millimeters on the periphery in conventional electrophotographic image forming apparatus. This is because when the toner image having a size equal to or larger than that of an electrophotographic image receiving sheet is transferred thereto, excess toner on the edges of the sheet or excess toner applied out of the sheet deposits on and stains the image forming apparatus.

In photo shops ("minilab systems") or DPE (developing, printing, enlargement) shops which serve to develop and print photographs in situ, a compact printer equipped with a developing unit is placed in the store front to thereby develop and print photographs. Such minilab systems require a relatively large area to equip the printer and a relatively great capital investment, consume large quantity of electric power, must replenish the developer (developing agent), fixing agent and water, must wash the tank and racks periodically and must treat waste liquid, thus requiring much effort and cost.

SUMMARY OF THE INVENTION

Accordingly, an object of the present invention is to provide an electrophotographic image forming apparatus that can produce high-quality electrophotographic prints that are equal to silver-halide photographs, in which the hardware such as a medium (electrophotographic image receiving sheet), a printer (image forming apparatus) and a unit for aftertreatment (including image smoothing and fixing) optimally matches with the toner. Another object of the present invention is to provide an image forming system of dry system which does not require treatment of a developing agent, fixing agent, water and waste liquids thereof and achieves space and power savings.

Specifically, the present invention provides, in a first aspect, an image forming apparatus including a forming unit configured to form a latent electrostatic image on a latent electrostatic image bearing member based on information on a digital image; a developing unit configured to develop the latent electrostatic image with a toner to thereby form a visible image; a transferring unit configured to transfer the visible image to one of an electrophotographic image receiving roll and an electrophotographic image receiving sheet; and a smoothing and fixing unit configured to smooth and fix the transferred image on the one of the electrophotographic image receiving roll and the electrophotographic image receiving sheet, to thereby form one of a series of electrophotographic prints and an electrophotographic print. Thus, the hardware such as the medium, (electrophotographic image receiving sheet), printer (image forming apparatus) and a unit for after-treatment such as image smoothing and fixing is optimized with the toner, and the image forming apparatus can produce high-quality electrophotographic prints that are equal to silver-halide photographs.

The present invention further provides, in a second aspect, an image forming system including the above-mentioned image forming apparatus, a feeding unit configured to feed information from a user to the image forming apparatus and a billing unit. Thus, the image forming system is placed at the store front of, for example, photo shops, convenience stores, copy centers and stationery stores and efficiently and conveniently provides high-quality electrophotographic prints that are equal to silver-halide photographic prints. In addition, the image forming system is of dry system which does not require liquid management and achieves space and power savings.

In addition and advantageously, the present invention provides an electrophotographic print which is produced by the image forming apparatus of the present invention. Thus, high-quality electrophotographic prints that are equal to silver-halide photographic prints can be provided according to demands of users.

Further objects, features and advantages of the present invention will become apparent from the following description of the preferred embodiments with reference to the attached drawings.

DESCRIPTION OF THE PREFERRED EMBODIMENTS (Image Forming Apparatus)

The image forming apparatus of the present invention comprises a forming unit configured to form a latent electrostatic image, a developing unit, a transferring unit, and a smoothing and fixing unit configured to smooth and fix the image. The apparatus may further comprise one or more other units such as a processing and controlling unit configured to process and control the image, a cutting unit configured to cut an electrophotographic image receiving roll, a cutting unit configured to cut a series of electrophotographic prints, a removing unit configured to remove a peripheral margin, a rewinding unit configured to rewind a roll, a backface printing unit, and a correcting unit configured to correct the image.

An image forming apparatus of the present invention according to a first-embodiment comprises a processing and controlling unit configured to process and control the image, a forming unit configured to form a latent electrostatic image, a developing unit, a cutting unit configured to cut a roll, a transferring unit, a smoothing and fixing unit configured to smooth and fix the transferred image, and a removing unit configured to remove a peripheral margin and may further comprise one or more other units according to necessity. Thus, the apparatus can produce high-quality electrophotographic prints that are equal to silver-halide photographic prints.

Figure 1:
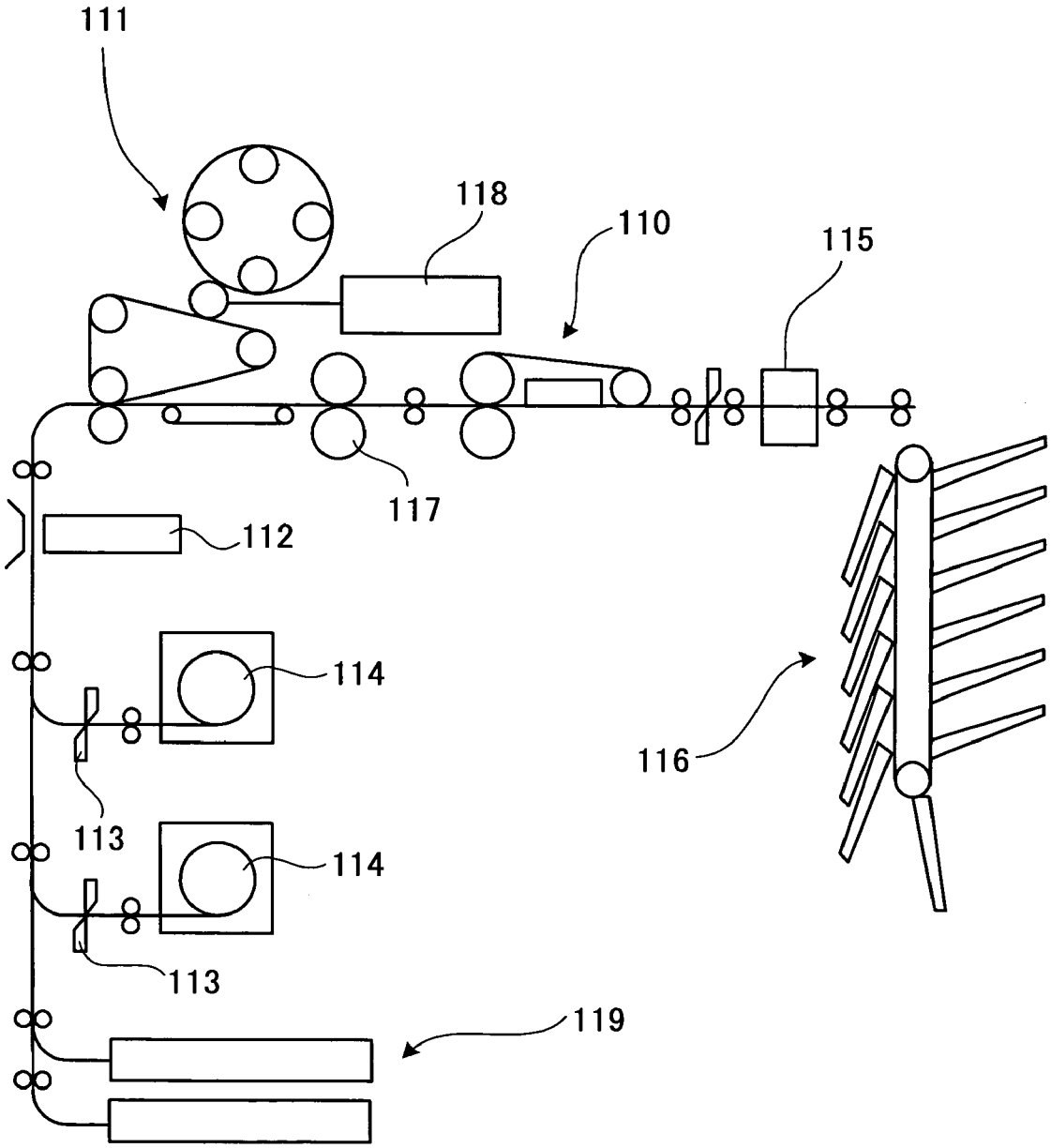
FIG. 1 is a schematic diagram of an electrophotographic image forming apparatus, according to a first embodiment of the present invention.

With reference to FIG. 1, the image forming apparatus according to the first embodiment comprises, for example, an image forming unit 111 serving as the processing and controlling unit configured to process and control the image, the forming unit configured to form a latent electrostatic image, the developing unit and the transferring unit; a roll cutter 113 serving as the cutting unit configured to cut a roll; a smoothing and fixing unit 110 serving as the smoothing and fixing unit configured to smooth and fix the transferred image; an X-Y cutter 115 serving as the removing unit configured to remove a peripheral margin; an electrophotographic image receiving roll 114; a print head 112 for backside printing; and a sorter 116. There is also provided an image exposing unit (raster optical scanner; ROS) 118. The apparatus may comprise two or more units of the electrophotographic image receiving roll 114. Where necessary, the apparatus may further comprise a sheet cassette 119 that houses cut paper of various sizes and types and/or a heating and pressing roller 117 serving as a primary image-fixing unit.

An image forming apparatus according to a second embodiment of the present invention comprises a processing and controlling unit configured to process and control the image, a forming unit configured to form a latent electrostatic image, a developing unit, a cutting unit configured to cut a roll, a transferring unit, a smoothing and fixing unit configured to smooth and fix the transferred image, a cutting unit configured to cut prints and remove peripheral margin, and a rewinding unit configured to rewind a roll and may further comprise one or more other units according to necessity. Thus, the apparatus can produce high-quality electrophotographic prints equal to silver-halide photographic prints, effects economy in the electrophotographic image receiving sheets and produces electrophotographic prints at low cost. In the rewound roll, an image forming surface on which an image is to be formed is prevented from adhesion of foreign matters such as paper powder or dust formed during cutting of the roll into sheets, thus avoiding decreased image quality of prints and reducing cutting failures due to adhesion of the foreign matters.

Figure 2:
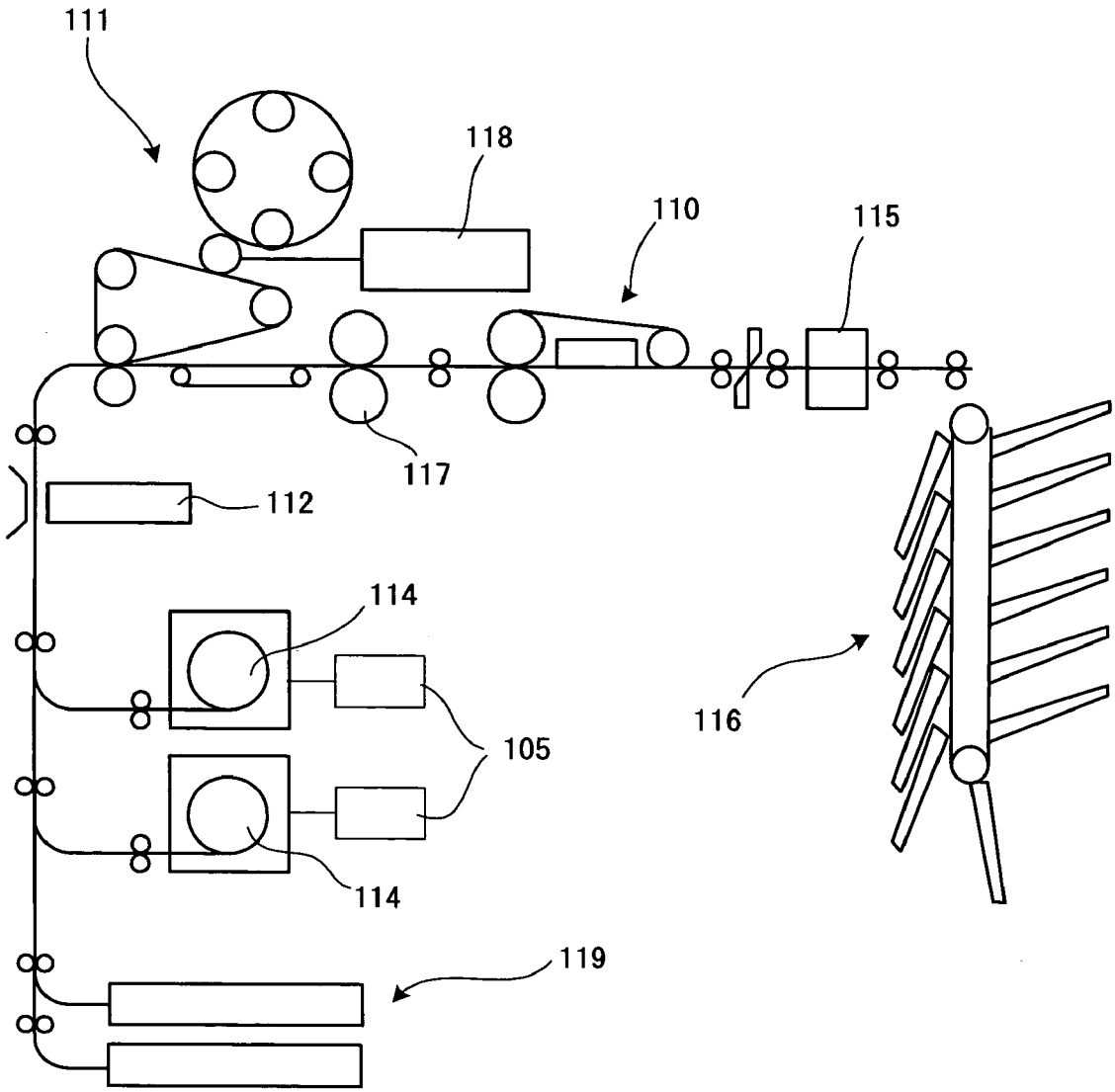
FIG. 2 is a schematic diagram of an electrophotographic image forming apparatus, according to a second embodiment of the present invention.

With reference to FIG. 2, the image forming apparatus according to the second embodiment comprises, for example, an image forming unit 111 serving as the processing and controlling unit configured to process and control the image, the forming unit configured to form a latent electrostatic image, the developing unit and the transferring unit; an electrophotographic image receiving roll 114; a smoothing and fixing unit 110 for image smoothing and fixing serving as the smoothing and fixing unit configured to smooth and fix the transferred image; an X-Y cutter 115 serving as the removing unit configured to remove a peripheral margin; a print head 112 for backside printing; a sorter 116; a rewinding mechanism 105 serving as the unit for rewinding a roll; and an image exposing unit (ROS) 118. The apparatus may comprise two or more units of the electrophotographic image receiving roll 114. Where necessary, the apparatus may further comprise a sheet cassette 119 that houses cut paper of various sizes and types and/or a heating and pressing roller 117 serving as a primary image-fixing unit.

<Unit for Image Processing and Controlling>

The unit for image processing and controlling is a unit for capturing inputted image data as digital image data, processing the digital image data and controlling the output thereof to thereby produce a digital image.

The digital image data can be any suitable image data selected according to the purpose, and examples thereof are (1) image data read out from a film image using a film scanner, the film image being taken with a film camera; (2) processed image data derived from photographed image data; (3) image data taken with a digital still camera (DSC); (4) image data captured from a digital video (DV) camera or recorder; (5) image data read out from a reflection copy with a reflection scanner; (6) image data inputted into, for example, a receiver of a personal computer; and (7) image data inputted from a mobile data terminal, an e-mail, a telephone line or network server. Each of these data can be used alone or in combination. The image data (3) taken with the digital still camera (DSC) can reduce grains on a print due to a negative image and can thereby produce a desirable color electrophotographic print. The image data (4) captured from a digital video (DV) camera or recorder enables continuous shooting and printing and can produce continuous shooting prints and index prints.

An apparatus for the image processing and image output control is not specifically limited, may be selected according to the purpose and includes, for example, (1) an apparatus capable of capturing any image data from a portable memory on which image data are recorded, (2) an apparatus capable of accessing a network and capable of capturing image data accumulated in a server connected to the network, (3) an apparatus capable of scanning an analogue image and capturing the image as a digital image, (4) an apparatus capable of connecting to a mobile data terminal and capable of capturing image data in the mobile data terminal, (5) an apparatus capable of selectively performing any additional image processing, (6) an apparatus capable of distinguishing between characters and images and capable of performing a specific image processing, and (7) an apparatus using a three-dimensional look-up table (LUT).

Each of these apparatus can be used alone or in combination.

Examples of the apparatus (1) capable of capturing any image data from a portable memory on which image data are recorded are CompactFlash® Card readers, SmartMedia readers, Memory Stick readers, xD-Picture Card readers, CD-ROM readers, DVD-R readers, ZIP disk readers, and MO readers.

Examples of the apparatus (2) capable of accessing a network and capable of capturing accumulated image data from a server connected to the network are modems for analogue telephone lines, integrated services digital network (ISDN) terminal adapters, asymmetrical digital subscriber line (ADSL) modems, optical fiber communication modems, Ethernet adapters, local area wireless network (wireless LAN) adapters, and Bluetooth adapters.

Examples of the apparatus (3) capable of scanning an analogue image and capturing the image as a digital image are flatbed scanners, and drum scanners. Examples of shooting devices for use herein are charge-coupled device (CCD) image sensors, and complementary metal-oxide semiconductor (C-MOS) image sensors.

Examples of the apparatus (4) capable of connecting to a mobile data terminal and capable of capturing image data therefrom are cellular phone access units, microcellular phone access units, USB access units, wireless LAN adapters, Bluetooth adapters, CompactFlash (R) Card type access units, and Memory Stick type access units. Examples of the mobile data terminal are cellular phones, microcellular phones, notebook computers, and personal data assistants (PDAs). These mobile data terminals are compact, lightweight and portable and can be connected to a network in various places.

Examples of the additional image processing in the apparatus (5) capable of selectively performing any additional image processing are framing, printing of a name, printing of date, sepia tone processing, monochrome tone processing, splitting, and close-up.

The three-dimensional look-up table (LUT) for use in the apparatus (7) is used to reproduce image data desirably on a print and can freely correct, without mixing, an image produced by digitized CCD signals derived from original image data as in so-called a "gamma table."

<Unit for Forming a Latent Electrostatic Image>

The unit for forming a latent electrostatic image is a unit for forming a latent electrostatic image on latent electrostatic image bearing member on the basis of information on the digital image.

The latent electrostatic image bearing member (hereafter, as the case may be, referred to as a "photoconducting insulator" or "photoconductor") is not particularly limited as regards material, shape, construction or size, and may be suitably selected from among those known in the art, but its shape may be that of a drum, and its material may be that of an inorganic photoconductor, such as amorphous silicon or selenium, or an organic photoconductor such as polysilane or phthalopolymethane. Among these, amorphous silicon is preferred from the viewpoint of long life.

The latent electrostatic image can be formed for example by uniformly charging the surface of the latent electrostatic image bearing member, and irradiating it imagewise, which may be performed by the latent electrostatic image forming unit.

The latent electrostatic image forming unit for example comprises at least a charger which uniformly charges the surface of the latent electrostatic image bearing member, and a light irradiator which exposes the surface of the latent image carrier imagewise.

The charging may for example be performed by applying a voltage to the surface of the latent electrostatic image bearing member using the charger.

The charger is not particularly limited and may be suitably selected according to the purpose, examples being contact chargers known in the art such as those equipped with a conductive or semi-conductive roller, brush, film or rubber blade, and non-contact chargers using corona discharge such as a corotron or scorotron.

The light irradiation can be performed by irradiating the surface of the latent electrostatic image bearing member imagewise, for example using the light irradiator.

The light irradiator is not particularly limited and may be suitably selected according to the purpose provided that it can expose the surface of the latent electrostatic image bearing member charged by the charger in the same way as the image to be formed, for example an light irradiator such as a copy optical system, a rod lens array system, a laser optical system or a liquid crystal shutter optical system.

<Developing Unit>

The developing unit is a unit for developing the latent electrostatic image on the latent electrostatic image bearing member using a toner to thereby form a visible image.

The visible image (toner image) can be formed for example by developing the latent electrostatic image using the toner, which can be performed by the conventional developing unit.

The developing unit can be any suitable developing unit such as one comprising at least a developing unit that is capable of housing the toner or a developer and applying the toner or developer to the latent electrostatic image in contact manner or non-contact manner.

The developing unit may be the dry type or wet type, and may be a monochrome developing unit or a multi-color developing unit. Examples are units comprising a stirrer which charge the toner or the developer by friction stirring, and units comprising a rotatable magnet roller.

In the developing unit, the toner and the carrier may for example be mixed and stirred together. The toner is thereby charged by friction, and forms a magnetic brush on the surface of the rotating magnet roller. As this magnet roller is arranged near the latent electrostatic image bearing member (photoconductor), part of the toner in the magnetic brush formed on the surface of this magnet roller moves to the surface of this latent electrostatic image bearing member (photoconductor) due to the force of electrical attraction. As a result, the latent electrostatic image is developed by this toner, and a visible toner image is formed on the surface of this latent electrostatic image bearing member (photoconductor).

The developer to be housed in the developing unit comprises color toners and may be either a one-component developer or two-component developer.

The color toners preferably comprise four or more colors and include a yellow (Y) toner, a magenta (M) toner, a cyan (C) toner, and a black (K) toner. The color toners more preferably comprise six or more colors and include a yellow (Y) toner, a magenta (M) toner, a cyan (C) toner, a black (K) toner, a light magenta (LM) toner, and a light cyan (LC) toner.

Color Toners

Fine particles for use in the color toners are not specifically limited and may be selected according to the purpose.

Preferred examples of the fine particles are those prepared by the following method. Initially, a toner material containing at least a binder resin and a coloring agent is added to an organic solvent and thereby yields a solution mixture (an oil phase) containing the dissolved binder resin and the dispersed coloring agent. The thus yielded oil phase is suspended in an aqueous medium, and the organic solvent is removed from the suspension, and the residue is granulated to thereby yield the fine particles.

A binder resin for use in the toners is not specifically limited, may be selected according to the purpose, but is preferably a polyester resin. The acid value of the polyester resin is preferably 1 mgKOH/g to 50 mgKOH/g, and more preferably 3 mgKOH/g to 30 mgKOH/g as determined according to Japanese Industrial Standards (JIS) K 0070. When the acid value is less than 1 mgKOH/g, a stable aqueous dispersion may not be obtained. When it exceeds 50 mgKOH/g, the toners may absorb excess amounts of water. The acid value of the polyester resin can be controlled by changing the proportional ratio of an acid component to an alcohol component or by neutralizing the acid with the alcohol.

The polyester resin for use herein preferably has a glass transition point Tg as determined with a differential scanning calorimeter of from 20° C. to 120° C. The glass transition point can be controlled by changing the compositional ratios of constitutional monomers. The polyester resin preferably has a number-average molecular weight (Mn) of from 2000 to 90000. When the number-average molecular weight (Mn) is less than 2000, fine particles may not be obtained by drying. When it exceeds 90000, the oil phase may become highly viscous.

Fine particles for use in the present invention may be produced by using the polyester resin having the above-specified acid value or glass transition point Tg in the following manner. Initially, a pigment is dispersed in, and the polyester resin is dissolved in an appropriate organic solvent to thereby yield an oil phase. A neutralizing agent is added to the oil phase to thereby ionize carboxyl groups of the polyester resin. Next, the oil phase is added to an aqueous medium to invert the phase, and the solvent is removed by distillation to thereby yield the fine particles. The oil phase may further comprise dispersed internal additives such as waxes and charge control agents. The resulting fine particles comprise an ionic polyester with a high acid value preferentially gathered on their surfaces and a wax and a polyester with a low acid value positioned in their cores.

While depending on the average particle diameter of the resulting toner, the average particle diameter of the fine particles is preferably from 0.05 μm to 3 μm, and more preferably from 0.1 μm to 1 μm. When the average particle diameter exceeds 3 μm, a toner of a small particle diameter having a final average particle diameter of about 5 μm may not be obtained. When it is less than 0.05 μm, the particles may not be stably dispersed, and/or component waxes and pigments may not be satisfactorily dispersed.

The polyester resin for use as the binder resin may be produced by subjecting a polyhydric alcohol component and a polyvalent carboxylic acid component as polymerizable monomers to polycondensation, where necessary, in the presence of a catalyst.

Examples of the polyhydric alcohol component as the polymerizable monomer are diols such as polyoxypropylene (2,2)-2,2-bis(4-hydroxyphenyl)propane, polyoxypropylene (3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl) propane, and polyoxypropylene(2,0)-polyoxyethylene(2,0)-2,2-bis(4-hydroxyphenyl) propane; as well as ethylene glycol, diethylene glycol, triethylene glycol, polyethylene glycol, propylene glycol, dipropylene glycol, isopentyl glycol, hydrogenated bisphenol A, 1,3-butane diol, 1,4-butane diol, neopentyl glycol, xylylene glycol, 1,4-cyclohexanedimethanol, glycerol, trimethylolethane, trimethylolpropane, pentaerythritol, bis-(β-hydroxyethyl) terephthalate, tris-(β-hydroxyethyl) isocyanurate, and 2,2,4-trimethylolpentane-1,3-diol. Hydroxycarboxylic acid components, such as p-hydroxybenzoic acid, vanillic acid, dimethylolpropionic acid, malic acid, tartaric acid, and 5-hydroxyisophthalic acid, can also be added herein.

Examples of the polyvalent carboxylic acid component are malonic acid, succinic acid, glutaric acid, dimer acid, phthalic acid, isophthalic acid, terephthalic acid, dimethyl isophthalate, dimethyl terephthalate, monomethyl terephthalate, tetrahydroterephthalic acid, methyltetrahydrophthalic acid, hexahydrophthalic acid, dimethyltetrahydrophthalic acid, endomethylene hexahydrophthalic acid, naphthalenetetracarbuxylic acid, diphenolic acid, trimellitic acid, pyromellitic acid, trimesic acid, cyclopentanedicarboxylic acid, 3,3',4,4'-benzophenonetetracarboxylic acid, 1,2,3,4-butanetetracarboxylic acid, 2,2-bis-(4-carboxyphenyl)propane, diimidocarboxylic acid produced from trimellitic acid anhydride and 4,4-diaminophenylmethane, tris(β-carboxyethyl)isocyanurate, polyimidocarboxylic acid containing an isocyanurate ring, and polyimidocarboxylic acid containing an isocyanate ring produced from a trimer reactant of tolylene diisocyanate, xylylene diisocyanate, or isophorone diisocyanate and trimellitic acid anhydride. Each of these compounds can be used alone or in combination. Among them, trivalent or higher polycarboxylic acids and trihydric and higher alcohols are preferred. Thus, a cross-linked polyester which is desirable in view of the fixing strength and stability such as anti-offset properties can be produced.

A desired polyester resin can be easily produced by subjecting these raw materials to polycondensation according to a conventional procedure. The binder resin preferably comprises a color toner resin having excellent transparency and color development properties and more preferably comprises two or more of the polyester resins obtained by the aforementioned method and having different glass transition points (Tgs) or different acid values for better toner image-fixing and better formation of particles.

Typical examples of the polyester resin for use as the binder and the physical properties thereof are shown in Table 1 and Table 2, respectively.

TABLE 1

| Composition (weight part) | | Polyester resin | | | |
|---|---|---|---|---|---|
| | | R-1 | R-2 | R-3 | R-4 |
| Alcohol component | Polyoxypropylene(2.2)-2,2-bis (4-hydroxyphenyl)propane | 100 | 100 | 100 | 100 |
| | Ethylene glycol | | | | 80 |
| Acid component | Terephthalic acid | 100 | 20 | 80 | 10 |
| | Isophthalic acid | | 20 | | |
| | Maleic anhydride | | | 20 | |
| | Trimellitic anhydride | | | | 10 |
| | Dodecenylsuccinic acid | | 60 | | |
| Catalyst | Dibutyltin oxide | 0.1 | 0.1 | 0.1 | 0.1 |

TABLE 2

| Polyester resin | Molecular weight (Mw) | Acid value | Tg (° C.) | Tm (° C.) |
|---|---|---|---|---|
| R-1 | 9000 | 25 | 65 | 102 |
| R-2 | 5000 | 8 | 50 | 85 |
| R-3 | 8000 | 31 | 68 | 110 |
| R-4 | 6000 | 6 | 49 | 75 |

The binder resin may further comprise another resin in addition to the polyester resin. Such other resins include, but are not limited to, styrene resins, acrylic resins, styrene-acrylic resins, silicone resins, epoxy resins, diene resins, phenolic resins, terpene resins, coumarin resins, amide resins, amide-imide resins, butyral resins, urethane resins, and ethylene-vinyl acetate resins.

The binder resin mainly comprises the polyester resin and comprises another resin in an amount of preferably from 0 to 30 parts by weight to 100 parts by weight of the binder resin.

The polyester resin in the toner material is dissolved in an organic solvent capable of dissolving the polyester resin. While depending on the constitutional components of the polyester, the organic solvent can be selected from, for example, toluene, xylenes, hexane, and other hydrocarbons; methylene chloride, chloroform, dichloroethanes, and other halogenated hydrocarbons; ethanol, butanol, benzyl alcohol, tetrahydrofuran, and other alcohols and ethers; methyl acetate, ethyl acetate, butyl acetate, isopropyl acetate, and other esters; acetone, methyl ethyl ketone, diisobutyl ketone, cyclohexanone, methylcyclohexanone, and other ketones. These organic solvents are capable of dissolving the polyester resin but may not dissolve the coloring agent and other additives.

The weight ratio of the toner material to the organic solvent is preferably from 10:90 to 80:20, more preferably from 30:70 to 70:30, and further preferably from 40:60 to 60:40 for better formation of fine particles by suspension granulation and for better yield of toner particles by aggregation.

Examples of the neutralizing agent for neutralizing the polyester resin are aqueous ammonia, aqueous solution of sodium hydroxide, and other basic aqueous solutions; allylamine, isopropylamine, diisopropylamine, ethylamine, diethylamine, triethylamine, 2-ethylhexylamine, and other amines. The amount of the neutralizing agent is as enough as to neutralize the acid value of the polyester resin.

The coloring agent is added together with the binder resin to a toner material composition and is dispersed in the fine particles. The coloring agent may further be incorporated into the fine particles by heteroaggregation during growth of the particles. Examples of the coloring agent are known or conventional organic pigments, inorganic pigments, and dyes such as Color Index (C. I.) Pigment Red 48:1, C. I. Pigment Red 57:1, C. I. Pigment Red 122, C. I. Pigment Yellow 17, C. I. Pigment Yellow 97, C. I. Pigment Yellow 12, C. I. Pigment Blue 15:1, C. I. Pigment Blue 15:3, lamp black (C. I. No. 77266), rose bengal (C. I. No. 45432), carbon black, nigrosine dye (C. I. No. 50415B), metal complex salt dyes, derivatives of metal complex salt dyes, and mixtures of these substances. Examples of the coloring agent also include silica, aluminum oxide, magnetite and ferrites, cupric oxide, nickel oxide, zinc oxide, zirconium oxide, titanium oxide, magnesium oxide, and other metal oxides, and mixtures of these substances.

The content of the coloring agent in the toner is preferably such that a visible image with sufficient density can be formed and is preferably from 1 parts by weight to 100 parts by weight, and more preferably from 2 parts by weight to 20 parts by weight, relative to 100 parts by weight of the toner, although it varies depending on the particle diameter and amount of the toner.

A wax may be added to the toner material and/or may be incorporated into the toner by heteroaggregation during growth of the toner particles. The wax for use herein is preferably low-melting point wax having a melting point of 110° C. or lower or a latent heat of fusion of 230 mJ/mg or less. Such a low-melting point wax effectively serves as a releasing member between a fixing roller and a toner interface to thereby prevent offset at high temperatures. Waxes having a melting point exceeding 110° C. or a latent heat of fusion exceeding 230 mJ/mg may not effectively serve as a releasing member. Those having a melting point of 30° C. or lower may not exhibit sufficient anti-blocking properties and storage stability of the toner and are not desirable. The melting point is determined from a maximum endothermic peak in differential scanning calorimetry (DSC).

The wax for use herein is not specifically limited and may be selected according to the purpose, as long as it has releasing properties. Examples of the wax are naturally-occurring waxes such as carnauba wax, cotton wax, Japan wax, rice bran wax, and other vegetable waxes; beeswax, lanolin, and other animal waxes; ozokerite, ceresine, and other mineral waxes: paraffin wax, microcrystalline wax, petrolatum, and other petroleum waxes, as well as synthetic waxes such as Fischer-Tropsch wax, polyethylene wax, and other synthetic hydrocarbon waxes; 12-hydroxystearamide, stearamide, anhydrous phthalimide, and other fatty acid amides; chlorinated hydrocarbons; and esters, ketones, and ethers. In addition to the above materials, homopolymers or copolymers (for example, a copolymer of n-stearyl acrylate-ethyl methacrylate) of polyacrylates such as poly(n-stearyl methacrylate) and poly(n-lauryl methacrylate), and other crystalline polymers having a long alkyl group at the side chain and having a relatively low molecular weight are given as examples of the releasing agent. Among these materials, petroleum waxes or synthetic waxes such as paraffin wax and microcrystalline wax are preferred.

The micronization of the wax (releasing agent) can be performed by any one of conventionally known methods using, for example, an emulsifying and dispersing apparatus as described in Report-1 of Research Group on Reaction Engineering, "Emulsion Dispersion Technology and Particle Size Control of Polymer Fine Particles, Chapter 3" (published by The Society of Polymer Science, Japan, March, 1995). A method (dissolution/precipitation method) may be also used in which, using a suitable solvent which is compatible or miscible with an organic solvent used for producing a toner and does not dissolve a releasing agent at room temperature, a releasing agent is added to this solvent and dissolved under heat, followed by gradually cooling the resulting solution to room temperature to precipitate a micronized releasing agent. In addition, a method (vapor phase vaporizing method) may be used in which a releasing agent is heated and vaporized in an inert gas such as helium gas to prepare particles of the releasing agent in a vapor phase, in succession the particles are adsorbed by, for example, a cooled film to recover these particles, and the recovered particles are dispersed in a solvent. Further, each of these methods may preferably be combined with a mechanical milling method using a medium, which is more effective for micronization.

The toner of the present invention may also contain other components such as internal additives, charge control agents and inorganic particles. Examples of the internal additives are metals such as ferrite, magnetite, reduced iron, cobalt, nickel and manganese, alloys or magnetic bodies such as compounds containing these metals.

As the charge control agent, a compound for use in a powdery toner selected from metal salts of benzoic acid, metal salts of salicylic acid, metal salts of alkylsalicylic acid, metal salts of catechol, metal-containing bisazo dyes, tetraphenyl borate derivatives, quaternary ammonium salts, and alkylpyridinium salts and optional combinations of these compounds can be desirably used.

The amount of the charge control agent is preferably from 0.1% by weight to 10% by weight, and more preferably from 0.5% by weight to 8% by weight of the toner. When the amount is less than 0.1% by weight, the charge control agent may not sufficiently exhibit its charge control function. When it exceeds 10% by weight, the toner may have an excessively low resistance and may not be used in practice.

In addition, a metallic soap, an inorganic metal salt, an organic metal salt, or mixture thereof may be used as the above charge control agent. Examples of such a metallic soap include aluminum tristearate, aluminum distearate; stearates of barium, calcium, lead, and zinc; linolenic acid salts of cobalt, manganese, lead, and zinc; octanoates of aluminum, calcium, and cobalt; oleates of calcium and cobalt; zinc palmitate; naphthenates of calcium, cobalt, manganese, lead, and zinc; and resinates of calcium, cobalt, manganese, lead, and zinc. The inorganic or organic metal salts are, for example, salts in which a cationic moiety in the metal salt is selected from the group consisting of metals of Group Ia, Group IIa, and Group IIIa of the Periodic Table of Elements.

The amount of each of these charge control agents or cleaning aids is generally preferably from 0.1 parts by weight to 10 parts by weight and more preferably from 0.1 parts by weight to 5 parts by weight to 100 parts by weight of the toner. When the amount is less than 0.1 parts by weight, a desired effect may not be obtained sufficiently. In contrast, an amount exceeding 10 parts by weight may cause a reduction in the powder fluidity of the toner, which makes it difficult to use the resulting toner.

As the surfactant, ionic and nonionic surfactants can be used. Specific examples of anionic surfactants include alkylbenzenesulfonates, alkylphenylsulfonates, alkylnaphthalenesulfonates, higher fatty acid salts, sulfates of higher fatty acid esters, and sulfonates of higher fatty acid esters. Examples of the cationic surfactants are primary, secondary, and tertiary amine salts, and quaternary ammonium salts. Examples of the nonionic surfactants are polyoxyethylene nonyl phenyl ether, polyoxyethylene octyl phenyl ether, polyoxyethylene dodecyl phenyl ether, polyoxyethylene alkyl ethers, polyoxyethylene fatty acid esters, sorbitan fatty acid esters, polyoxyethylene sorbitan fatty acid esters, and fatty acid alkylolamides. Each of these surfactants can be used alone or in combination. Preferably, the surfactant is used in an amount ranging from 0.001 parts by weight to 5 parts by weight relative to the principal aqueous medium in the aqueous phase.

Next, a method for producing a toner by aggregation of fine particles will be described, which fine particles have been formed by suspension granulation from the mixture solution of the toner materials. The fine particles having a polyester resin with a carboxylic salt on their surfaces are finely dispersed in the aqueous medium by action of an electric double layer. The zeta potential of the fine particles is preferably controlled within a range from 20 mV to 70 mV. By adding an electrolyte to the aqueous medium containing the dispersed fine particles under conditions such as to allow the polyester resin to be plasticized, the fine particles can grow to a desired toner particle diameter.

Examples of the electrolyte are sodium sulfate, ammonium sulfate, potassium sulfate, magnesium sulfate, sodium phosphate, sodium dihydrogen phosphate, ammonium chloride, calcium chloride, sodium acetate, and other inorganic and organic water-soluble salts. The amount of the electrolyte is generally preferably 0.01 moles to 2 moles per liter of an aqueous solution. The aqueous medium may be distilled water, ion-exchanged water, and other pure water but may further contain a known inorganic dispersing agent, a polymeric flocculating agent, and other components.

Preferably, the fine particles are granulated in the aqueous medium under a high shearing condition. To produce toner particles having particularly small particle diameters, a dispersing machine having a high speed shearing mechanism is preferably used. Among these dispersing machines, high-speed blade rotation type and forced gap-passing type homogenizers such as various homomixers, homogenizers, and colloid mills are more preferred.

During or after the process for granulating the fine particles, the organic solvent may be removed. The removal of the organic solvent may be performed at elevated temperatures or under reduced pressure. To remove the organic solvent at elevated temperatures, the organic solvent is preferably removed at a temperature in a range of which is lower than the boiling point of the organic solvent and does not largely exceed the glass transition point Tg of the binder resin. When the temperature for the removal of the solvent largely exceeds Tg of the binder resin, toners are probably fused with each other, which is undesirable. Though a desirable temperature range depends on the boiling point of the organic solvent and Tg of the used binder resin, the organic solvent is preferably removed with stirring at a temperature around 40° C. for 3 hours to 24 hours. When the removal is performed under reduced pressure, it is preferred to perform at a pressure of 20 mmHg to 150 mmHg.

To control the internal structure of the toner obtained by growth of the fine particles by aggregation, it is preferred that particles of another polyester having a different composition from that of the polyester in the fine particles are sequentially added during the process of the particle aggregation. Thus, the fine particles are incorporated into the core of the toner at early stages of particle aggregation, and the polyester particles added thereafter cover the surface of the toner.

Preferably, the resulting toner is washed to remove an inorganic dispersion stabilizer remained on the surfaces of the toner particles. For the washing, acids such as hydrochloric acid, nitric acid, formic acid, and acetic acid, which allows the inorganic dispersion stabilizer to be water-soluble, can be used. When these inorganic stabilizers and the aforementioned surfactants are hygroscopic and remain at the surface of the toner particles, the chargeability of the toners may vary depending on humidity and other surrounding conditions. It is therefore desirable that the inorganic dispersion stabilizer is removed as much as possible from the surface of the toner by washing in order to eliminate an adverse influence on the chargeability and powder fluidity of the toner.

The toner washed with an acid or a base may be again washed with a basic aqueous solution such as sodium hydroxide as required. Thus, a part of ionic substances, which remains on the surface of the toner and is insolubilized under basic conditions, is again solubilized by the basic aqueous solution and removed, with the result that the chargeability and the powder fluidity of the toner is improved. Furthermore, these washing treatments using an acid or a basic aqueous solution effectively remove free releasing agents (waxes) adhering to the surface of the toner. The washing treatment can be more efficiently carried out by appropriately selecting a stirrer, an ultrasonic dispersing apparatus and the like used in the washing treatment as well as by controlling conditions of the pH of the washing liquid, the number of washings, and washing temperature. After the washing, processes such as filtration, decantation, and centrifugation are performed, followed by drying to obtain a toner for electrophotography.

The toner for electrophotography for use in the present invention mainly comprises the ionic surface fine particles and has an average particle diameter of preferably from 2 μm to 20 μm, more preferably from 3 μm to 10 μm, and further preferably from 3 μm to 7 μm. When the average particle diameter is less than 2 μm, it may be difficult to handle the powdery toner. When it exceeds 20 μm, the resulting toner may not yield highly precise images. The shapes of toners can be changed by controlling the composition of the raw materials of the toners, the conditions of the process for removing a solvent from toners after granulation process, and other conditions for the production thereof. The toners can be formed into various shapes, for example, from a spherical shape to an undefined shape. The toners may have fine irregularities, wrinkles, pores, or projections.

Known external additives may be added to the toner for use in the present invention to control the fluidity and the developing properties. Examples of the external additives are various inorganic oxide fine particles such as silica, alumina, titania, and cerium oxide, those produced by subjecting these fine particles to hydrophobic treatment as required, as well as vinyl polymers, and zinc stearate. The amount of the external additives is preferably in a range from 0.05 parts by weight to 5 parts by weight to 100 parts by weight of the toner particles before addition of the external additives.

The toner can be used in a known dry electrostatic charge developing method without any limitation. It can be adapted to, for example, a two-component developing method such as a cascade method, magnetic brush method, and microtoning method and a one-component developing method such as an electroconductive one-component developing method and an insulating one-component developing method as well as a non-magnetic one-component developing method. It is possible to design a unique process which effectively utilizes the low adhesion of the toner which is caused by its spherical shape.

The toner mainly comprises, as a binder resin, a polyester resin that cannot be produced by a conventional dispersion polymerization and suspension polymerization and comprises low-melting-point resins in the core and the surface thereof in a preferred proportion. The toner thereby has improved image-fixing properties at low temperatures and can avoid thermal blocking due to heating in an image-fixing process. The above method for producing the toner for electrophotography can disperse a low-melting-point resin into a polyester resin by a specific granulation method and can thereby easily produce a toner having satisfactory properties as powder. In addition, the method can uniformly disperse a releasing agent and other additives as fine particles into the toner particles. Hereinabove, such a low-melting-point resin is not used in conventional kneading and pulverization methods.

The toner may also contain an external additive when necessary. Examples of the external additive are inorganic powders and organic particles. Examples of inorganic particles are $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, CaO—$SiO_2$, $K_2O$—$(TiO_2)_n$, $Al_2O_3$-$2SiO_2$, $CaCO_3$, $MgCO_3$, $BaSO_4$, $MgSO_4$ and the like. Examples of organic particles are fatty acids and their derivatives, powdered metal salts thereof, and resin powders of fluorine resins, polyethylene resin, acrylic resins and the like. The average particle diameter of these powders may for example be 0.01 μm to 5 μm, but is preferably 0.1 μm to 2 μm.

The toner has a volume-average particle diameter of preferably 7 μm or less and more preferably 5.5 μm or less.

When the volume average particle diameter of the toner is too small, it may have an adverse effect on handling of the toner (supplementation, cleaning properties and flow properties), and particle productivity may decline. On the other hand, when the volume average particle diameter is too large, it may have an adverse effect on image quality and resolution due to granularity and transfer properties.

It is preferred that the toner according to the present invention satisfies the above toner volume average particle diameter range, and that the volume average particle distribution index (GSDv) is 1.3 or less.

It is preferred that the ratio (GSDv/GSDn) of the volume average particle distribution index (GSDv) and the number average particle distribution index (GSDn) is at least 0.95.

The toner according to the present invention preferably has the above toner volume average particle diameter range and has an average of shape factors represented by the following equation of from 1.0 to 1.5 and more preferably from 1.05 to 1.4.

$$\text{Shape factor}=(\pi\times L^2)/(4\times S)$$

(where, L is the maximum length of the toner particles, and S is the projection surface area of a toner particle).

When the toner has a volume-average particle diameter and a shape factor within the above-specified ranges, the toner serves to improve image quality such as graininess and resolution, is resistant to missing and/or blur accompanied with image transfer and does not invite deteriorated handleability even when the toner does not have a small average particle diameter.

The storage elasticity modulus G' (measured at an angular frequency of 10 rad/sec) of the toner itself at 150° C. is $1\times10^2$ Pa to $1\times10^5$ Pa, which is convenient for improving image quality and preventing offset in the fixing step.

The resolution of rendering a toner image from the digital image using color toners in the toner image forming unit is preferably 12000 dpi or higher and more preferably 2400 dpi or higher.

When the resolution is less than 1200 dpi, the resulting image may become rough.

<Unit for Cutting a Roll>

The unit for cutting a roll in the image forming apparatus according to the first embodiment is a unit for cutting the electrophotographic image receiving roll into electrophotographic image receiving sheets of a specific size.

The unit for cutting a roll in the image forming apparatus according to the second embodiment is a unit for cutting the series of electrophotographic prints into electrophotographic prints of a specific size.

The unit for cutting a roll can be any suitable one selected according to the purpose and examples thereof are a circular cutter, guillotine cutter, rotary cutter, and the like.

The electrophotographic image receiving sheet and electrophotographic print can have any suitable size according to the purpose such as L size (89 mm by 127 mm), A6 size (105 mm by 150 mm), A4 size (210 mm by 300 mm), postal-card size, business-card size, and the like.

The image forming apparatus may comprise one or more units of roll feeding unit for housing the electrophotographic image receiving roll. In this configuration, the electrophotographic image-receiving sheet roll can be used in combination with cut electrophotographic image receiving sheets. The latter sheets are placed in a sheet tray and are fed.

<Electrophotographic Image Receiving Sheet>

Each of the electrophotographic image receiving sheet and electrophotographic image receiving sheet roll comprises a support and at least one toner-image receiving layer which is arranged on or above the support and comprises a thermoplastic resin. It may further comprise at least one of additional layers appropriately selected according to necessity. Such additional layers include, for example, interlayers, protective layers, undercoat layers, cushioning layers, charge-control or antistatic layers, reflective layers, color-control layers, storage-stability improving layers, adhesion preventing layers, anticurling layers, and smoothing layers. Each of these layers can be a single layer or a multilayer.

The electrophotographic image receiving sheet is preferably in the form of a roll because the size of sheets can be easily changed and images can be printed at high speed. Where necessary, the roll can be used in combination with cut sheets housed in a sheet cassette.

[Support]

The support may be properly selected without particular limitations; examples of the support include raw paper, synthetic paper, synthetic resin sheet, coated paper, laminated paper, and the like. These supports may be of single layer or laminated layers. Among theses, the laminated paper coated with polyolefin resin layer on at least one side of the raw paper is preferred with respect to smoothness, gloss and elastic properties.

Raw Paper

The raw paper may be a high quality paper, for example, the paper described in Shashin kogaku no kiso—ginen shashin hen "Basic Photography Engineering—Silver Halide Photography" from CORONA PUBLISHING CO., LTD. (1979) pp. 223–240, edited by the Institute of Photography of Japan.

In the raw paper, it is preferred to use pulp fibers having a fiber length distribution as disclosed, for example, in JP-A No. 58-68037 (e.g., the sum of 24 mesh on and 42 mesh on is 20 to 45% by weight, and 24 mesh on is 5% by weight or less) in order to give the desired center line average roughness to the surface. Moreover, the center line average roughness may be adjusted by heating and giving a pressure to a surface of the raw paper, with a machine calender, super calender and the like.

The raw paper may be properly selected without particular limitations, provided that they are known materials for support. Examples of the raw paper material include natural pulp of needle-leaf tree or broad-leaf tree, mixture of natural pulp and synthetic pulp and the like.

As for the pulp available for the raw paper, broadleaf tree bleached kraft pulp (LBKP) is preferred from the viewpoint of good balance between surface flatness and smoothness of the raw paper, rigidity and dimensional stability (curl). Needle-leaf bleached kraft pulp (NBKP), broadleaf tree sulfite pulp (LBSP) and the like may also be available.

A beater or refiner and the like may be employed for beating the pulp.

The Canadian Standard Freeness of the pulp is preferably 200 to 440 ml CSF, and more preferably 250 to 380 ml CSF, to control contraction of paper during the treatment.

Various additives, for example, filler, dry paper reinforcer, sizing agent, wet paper reinforcer, fixing agent, pH regulator or other agents and the like may be added, if necessary, to the pulp slurry (hereafter, referred to as "pulp paper material") which is obtained after beating the pulp.

Examples of the filler include calcium carbonate, clay, kaolin, white clay, talc, titanium oxide, diatomaceous earth, barium sulfate, aluminum hydroxide, magnesium hydroxide and the like.

Examples of the dry paper reinforcer include cationic starch, cationic polyacrylamide, anionic polyacrylamide, amphoteric polyacrylamide, carboxy-modified polyvinyl alcohol and the like.

Examples of the sizing agent include aliphatic salts, rosin, derivatives of rosin such as maleic rosin and the like, paraffin wax, alkyl ketene dimer, alkenyl succinic anhydride (ASA), epoxy aliphatic amide, and the like.

Examples of the wet paper reinforcer include polyamine polyamide epichlorohydrin, melamine resin, urea resin, epoxy polyamide resin, and the like.

Examples of the fixing agent include polyfunctional metal salts such as aluminum sulfate, aluminum chloride, and the like; cationic polymers such as cationic starch, and the like.

Examples of the pH regulator include caustic soda, sodium carbonate, and the like.

Examples of other agents include defoaming agents, dyes, slime control agents, fluorescent whitening agents, and the like.

Moreover, softeners may also be added if necessary. For the softeners, ones which are disclosed on pp. 554–555 of *Paper and Paper Treatment Manual* (Shiyaku Time Co., Ltd.) (1980) and the like may be employed, for example.

These various additives may be used alone or in combination of two or more. The loadings of these additives may be properly selected; usually the loadings are preferably 0.1 to 1.0% by weight.

The pulp slurry or pulp paper material, to which the aforesaid various additives are compounded depending on the requirements, was formed into paper by means of paper machine such as hand paper machine, Fourdrinier paper machine, round mesh paper machine, twin wire machine, combination machine, and the like, followed by drying to prepare raw paper. In addition, sizing treatment on the surface may be provided prior to or following the drying if necessary.

The treatment liquid used for sizing a surface may be properly selected without particular limitations. The treatment liquid may be compounded with such material as water-soluble polymers, waterproof materials, pigments, dyes, fluorescent whitening agents, and the like.

Examples of the water-soluble polymer include cationic starch, polyvinyl alcohol, carboxy-modified polyvinyl alcohol, carboxymethyl cellulose, hydroxyethyl cellulose, cellulose sulfate, gelatin, casein, sodium polyacrylate, styrene-maleic anhydride copolymer sodium salt, sodium polystyrene sulfonate, and the like.

Examples of the waterproof material include latex emulsions such as styrene-butadiene copolymer, ethylene-vinyl acetate copolymer, polyethylene, vinylidene chloride copolymer and the like; polyamide polyamine epichlorohydrin and the like.

Examples of the pigment include calcium carbonate, clay, kaolin, talc, barium sulfate, titanium oxide, and the like.

As for the aforesaid raw paper, in order to improve the rigidity and dimensional stability (curling), it is preferred that the ratio (Ea/Eb) of the longitudinal Young's modulus (Ea) and the lateral Young's modulus (Eb) is within the range of 1.5 to 2.0. When the ratio (Ea/Eb) is less than 1.5 or more than 2.0, the rigidity and curling of the electrophotographic image-receiving material is likely to be inferior, and may interfere with paper during the conveying operation.

It has been found that, in general, the "stiffness" of the paper differs depending on the various manners in which the paper is beaten, and the elasticity (modulus) of paper produced by paper making process through beating operation may be employed as an important indication of the "stiffness" of the paper. The elastic modulus of the paper may be calculated from the following equation by using the relation of the density and the dynamic modulus which shows the physical properties of a viscoelastic object, and by measuring the velocity of sound propagation in the paper using an ultrasonic oscillator.

$$E=\rho c^2(1-n^2)$$

wherein "E" represents dynamic modulus; "ρ" represents density; "c" represents the velocity of sound in paper; and "n" represents Poisson's ratio.

Since n=0.2 or so in a case of ordinary paper, there is not much difference in the calculation, even if the calculation is performed by the following equation:

$$E=\rho c^2$$

Accordingly, if the density of the paper and acoustic velocity may be measured, the elastic modulus may be easily calculated. In the above equation, when measuring acoustic velocity, various instruments known in the art may be available, such as Sonic Tester SST-110 (Nomura Shoji Co., Ltd.) and the like.

The thickness of the raw paper may be properly selected depending on the application, usually 30 to 500 μm is preferred, 50 to 300 μm is more preferred, and 100 to 250 μm is still more preferred. The basis weight of the raw paper may be properly selected depending on the application, for example, 50 to 250 g/m$^2$ is preferred, and 100 to 200 g/m$^2$ is more preferred.

Synthetic Paper

Synthetic paper is a kind of paper of which the main component is polymer fibers other than cellulose. Examples of the polymer fibers include polyolefin fibers such as polyethylene, polypropylene, and the like.

Synthetic Resin Sheet (Film)

The synthetic resin sheet may be a synthetic resin formed in the shape of a sheet (film). Examples thereof include polypropylene film, stretched polyethylene film, stretched polypropylene, polyester film, stretched polyester film, nylon film, and the like. Further, films made white by stretching, white films containing a white pigment, and the like may be available.

Coated Paper

The coated paper is one produced by coating various resins on at least one surface of substrate such as raw paper, and the coated amount differs depending on the application. Examples of the coated paper include art paper, cast coated paper, Yankee paper, and the like.

Laminated Paper

The laminated paper is one which is formed by laminating materials selected from various resins, rubbers, polymer sheets or films on substrate such as raw paper. Examples of the laminating material include polyolefin resins, polyvinyl chloride resins, polyester resins, polystyrene resins, polymethacrylate resins, polycarbonate resins, polyimide resins, triacetyl cellulose, and the like. These resins may be used alone or in combination of one or more.

The aforesaid polyolefin is often low-density polyethylene (LDPE); when the heat resistance of the support should be enhanced, preferably, polypropylene, blend of polypropylene and polyethylene, high-density polyethylene (HDPE), blend of high-density polyethylene and low-density polyethylene and the like are utilized. From the viewpoint of cost and laminate applicability in particular, the blend of high-density polyethylene and low-density polyethylene is most preferable.

The blending ratio by weight of the high-density polyethylene and low-density polyethylene is preferably from 1:9 to 9:1, more preferably 2:8 to 8:2, and most preferably from 3:7 to 7:3. When thermoplastic resin layers are formed on both sides of the raw paper, preferably, the back side of the raw paper is formed of high-density polyethylene or a blend of high-density polyethylene and low-density polyethylene. The molecular weight of the polyethylene is not particularly limited, but it is preferable that melt indices of both high-density polyethylene and low-density polyethylene are 1.0 to 40 g/10-min and that the polyethylene exhibits a suitable extrusion property.

Further, these sheets or films may be applied a treatment so as to take a reflectivity against white color. Examples of such treatment include compounding a pigment such as titanium oxide or the like into the sheets or films.

The thickness of the support is preferably 25 to 300 μm, more preferably 50 to 260 μm, and still more preferably 75 to 220 μm. The rigidity of the support may vary depending on the application; preferably, the rigidity of the support utilized for the electrophotographic image receiving sheet of photographic image quality is similar to that of the support utilized for color silver halide photography.

Toner-image-receiving Layer

The toner-image-receiving layer is a toner-image-receiving layer for receiving a color or black toner to form an image. The toner-image-receiving layer receives a toner for image formation from a development drum or an intermediate transfer member by action of (static) electricity or pressure in a transfer process and fixes the toner as an image by action of, for example, heat and/or pressure in an image-fixing process.

The material of the toner-image-receiving layer contains at least a thermoplastic resin and contains various additives in order to improve the thermodynamic characteristics of the toner-image-receiving layer when necessary, for example, a releasing agent, plasticizer, coloring agent, filler, crosslinking agent, charge control agent, emulsifier or dispersing agent.

Thermoplastic Resin

The thermoplastic resin can be any suitable thermoplastic resin according to the purpose. Examples thereof are (1) olefinic resins, (2) styrenic resins, (3) acrylic resins, (4) poly(vinyl acetate)s and derivatives thereof, (5) polyamide resins, (6) polyester resins, (7) polycarbonate resins, (8) polyether resins or acetal resins, and (9) other resins. Each of these resins can be used alone or in combination. Among them, styrenic resins, acrylic resins and polyester resins are preferred because they have a large aggregation energy and enable the toner to be satisfactorily embedded.

Examples of the olefinic resins (1) are polyolefin resins such as polyethylenes and polypropylenes; and copolymers of an olefin such as ethylene or propylene with a vinyl monomer. Examples of such copolymers are ethylene-vinyl acetate copolymers and ionomer resins including ethylene-acrylic acid copolymers and ethylene-methacrylic acid copolymers. Examples of the derivatives of polyolefin resins are chlorinated polyethylenes and chlorosulfonated polyethylenes.

Examples of the styrenic resins (2) are polystyrenes, styrene-isobutylene copolymers, acrylonitrile-styrene copolymers (AS resins), acrylonitrile-butadiene-styrene copolymers (ABS resins), and polystyrene-maleic anhydride copolymers.

Examples of the acrylic resins (3) are poly(acrylic acid)s and esters thereof, poly(methacrylic acid)s and esters thereof, polyacrylonitriles and polyacrylamides.

The esters of poly(acrylic acid)s include, for example, homopolymers and multi-component copolymers of acrylic esters. Examples of the acrylic esters are methyl acrylate, ethyl acrylate, n-butyl acrylate, isobutyl acrylate, dodecyl acrylate, n-octyl acrylate, 2-ethylhexyl acrylate, 2-chloroethyl acrylate, phenyl acrylate, and methyl α-chloroacrylate.

The esters of poly(methacrylic acid)s include, for example, homopolymers and multi-component copolymers of methacrylic esters. Examples of the methacrylic esters are methyl methacrylate, ethyl methacrylate and butyl methacrylate.

Examples of the poly(vinyl acetate)s and derivatives thereof are poly(vinyl acetate)s, poly(vinyl alcohol)s prepared by saponifying poly(vinyl acetate)s, and polyvinylacetal resins prepared by reacting a poly(vinyl alcohol) with an aldehyde such as formaldehyde, acetaldehyde or butyraldehyde.

The polyamide resins (5) are polycondensates of a diamine with a dibasic acid, such as 6-nylon and 6,6-nylon.

The polyester resins (6) are prepared by polycondensation of an acid component and an alcohol component. The acid component can be any suitable one, and examples thereof are maleic acid, fumaric acid, citraconic acid, itaconic acid, glutaconic acid, phthalic acid, terephthalic acid, isophthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, trimellitic acid, pyromellitic acid, anhydrides or lower alkyl esters of these acids.

The alcohol component can be any suitable one according to the purpose. Among them, dihydric alcohols such as aliphatic diols and alkylene oxide adducts of bisphenol A are preferred. Examples of the aliphatic diols are ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of the alkylene oxide adducts of bisphenol A are polyoxypropylene (2.2)-2,2-bis(4-hydroxyphenyl)propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene (2.0)-2,2-bis(4-hydroxyphenyl)propane, and polyoxypropylene (6)-2,2-bis(4-hydroxyphenyl)propane.

Examples of the polycarbonate resins (7) are polycarbonates derived from bisphenol A and phosgene.

Examples of the polyether resins or acetal resins (8) are polyether resins such as poly(ethylene oxide)s and poly (propylene oxide)s; and acetal resins such as polyoxymethylenes prepared as a result of ring-opening polymerization.

The other resins (9) include, for example, polyurethane resins prepared as a result of polyaddition.

The thermoplastic resin is preferably such a thermoplastic resin as to satisfy the requirements in the physical properties of a toner image receiving layer comprising the thermoplastic resin in question and is more preferably such a thermoplastic resin that can satisfy, by itself, the requirements. It is also preferred that two or more resins exhibiting different physical properties as the toner image receiving layer are used in combination.

The thermoplastic resin used in the toner image receiving layer preferably has a molecular weight larger than that of a thermoplastic resin used in the toner. However, this relationship in molecular weight between two thermoplastic resins may not be applied to some cases. For example, when the thermoplastic resin used in the toner image receiving layer has a softening point higher than that of the thermoplastic resin used in the toner, the former thermoplastic resin may preferably have a molecular weight equivalent to or lower than that of the latter thermoplastic resin.

A mixture of resins having the same composition but different average molecular weights is also preferably used as the thermoplastic resin for the toner image receiving layer. The relationship in molecular weight between the thermoplastic resin used in the toner image receiving layer and that used in the toner is preferably one disclosed in JP-A No. 08-334915.

The thermoplastic resin for the toner image receiving layer preferably has a particle size distribution larger than that of the thermoplastic resin used in the toner.

The thermoplastic resin for the toner image receiving layer preferably satisfies the requirements in physical properties as disclosed in, for example, JP-A No. 05-127413, No. 08-194394, No. 08-334915, No. 08-334916, No. 09-171265, and No. 10-221877.

As the thermoplastic resins for the toner-image receiving layer, aqueous resins such as water-dispersible polymers and water-soluble polymers are preferred for the following reasons.

(i) These aqueous resins do not invite exhaustion of an organic solvent in a coating-and-drying process and are thereby environment friendly and have good workability.

(ii) Most of waxes and other releasing agents cannot be significantly dissolved in solvents at room temperature and are often dispersed in a medium (water or an organic solvent) before use. Such aqueous dispersions are more stable and suitable in production processes. When an aqueous composition containing the thermoplastic resin and a wax is applied and dried, the wax readily bleeds out on the surface of a coated layer, thus yielding the effects of the releasing agent (anti-offset properties and adhesion resistance) more satisfactorily.

The aqueous resin for use herein can be any water-dispersible or water-soluble polymer and can have any composition, bonding structure, molecular structure, molecular weight and distribution thereof, and configuration. The aqueous polymer may have a group that imparts water-dispersibility or water-solubility to the polymer. Examples of such groups are sulfonic group, hydroxyl group, carboxyl group, amino group, amide group, and ether group.

The water-dispersible polymer can be selected from water-dispersed resins, emulsions, copolymers, mixtures and cationic modified products thereof of the thermoplastic resins (1) to (9). Each of these polymers can be used alone or in combination.

The water-dispersible polymer can be suitably synthesized or is available as commercial products. For example, water-dispersible polyester-based polymers are commercially available as the Vylonal Series from Toyobo Co., Ltd, the Pesresin A Series from Takamatsu Oil & Fat Co., Ltd., the Tuftone UE Series from Kao Corporation, the WR Series from Nippon Synthetic Chemical Industry Co., Ltd., and the Elitel Series from Unitika Ltd. Water-dispersible acrylic polymers are commercially available as the Hiros XE, KE and PE series from Seiko Chemical Industries Co., Ltd., and the Jurymer ET series from Nihon Junyaku Co., Ltd.

The water-dispersible emulsion can be any suitable emulsion that preferably has a volume-average particle diameter of 20 nm or more. Examples of such emulsions are water-dispersible polyurethane emulsions, water-dispersible polyester emulsions, chloroprene emulsions, styrene-butadiene emulsions, nitrile-butadiene emulsions, butadiene emulsions, vinyl chloride emulsions, vinylpyridine-styrene-butadiene emulsions, polybutene emulsions, polyethylene emulsions, vinyl acetate emulsions, ethylene-vinyl acetate emulsions, vinylidene chloride emulsions, and methyl methacrylate-butadiene emulsions. Among them, water-dispersible polyester emulsions are preferred.

The water-dispersible polyester emulsions are preferably self-dispersible aqueous polyester emulsions, of which self-dispersible aqueous carboxyl-containing polyester emulsions are typically preferred. The "self-dispersible aqueous polyester emulsion" herein means an aqueous emulsion containing a polyester resin that is self-dispersible in an aqueous solvent without the use of an emulsifier and the like. The "self-dispersible aqueous carboxyl-containing polyester emulsion" means an aqueous emulsion containing a polyester that contains carboxyl groups as hydrophilic groups and is self-dispersible in an aqueous solvent.

The self-dispersible aqueous polyester emulsion preferably satisfies the following requirements (1) to (4). This type of polyester resin emulsion is self-dispersible requiring no surfactant, is low in moisture absorbency even in an atmosphere at high humidity, exhibits less decrease in its softening point due to moisture and can thereby avoid offset in image-fixing and failures due to adhesion between sheets during storage. The emulsion is water-based and is environmentally friendly and excellent in workability. In addition, the polyester resin used herein readily takes a molecular structure with high cohesive energy. Accordingly, the resin has sufficient hardness (rigidity) during its storage but is melted with low elasticity and low viscosity during an image-fixing process for electrophotography, and the toner is sufficiently embedded in the toner-image-receiving layer to thereby form images having sufficiently high quality.

(1) The number-average molecular weight Mn is preferably from 5000 to 10000 and more preferably from 5000 to 7000.

(2) The molecular weight distribution (Mw/Mn) is preferably 4 or less, and more preferably 3 or less, wherein Mw is the weight-average molecular weight.

(3) The glass transition temperature Tg is preferably from 40° C. to 100 ° C. and more preferably from 50° C. to 80° C.

(4) The volume average particle diameter is preferably from 20 nm to 200 nm and more preferably from 40 nm to 150 nm.

The content of the water-dispersible emulsion in the toner-image receiving layer is preferably from 10% by weight to 90% by weight, and more preferably from 10% by weight to 70% by weight.

The water-soluble polymer can be any suitable one preferably having a weight-average molecular weight (Mw) of 400,000 or less and can be suitably synthesized or is commercially available as products. Examples of such water-soluble polymers are poly(vinyl alcohol)s, carboxy-modified poly(vinyl alcohol)s, carboxymethylcellulose, hydroxyethylcellulose, cellulose sulfate, poly(ethylene oxide)s, gelatin, cationized starch, casein, poly(sodium acrylate)s, sodium styrene-maleic anhydride copolymers, and sodium polystyrene sulfonate, of which poly(ethylene oxide)s are preferred.

The water-soluble polymers are commercially available as, for example, various Pluscoats from Goo Chemical Co., Ltd. and the Finetex ES series from Dainippon Ink & Chemicals Inc. Examples of water-soluble acrylics are the Jurymer AT series from Nihon Junyaku Co., Ltd., Finetex 6161 and K-96 from Dainippon Ink & Chemicals Inc., and Hiros NL-1189 and BH-997L from Seiko Chemical Industries Co., Ltd.

Typical disclosure of the water-soluble polymers can be found in, for example, Research Disclosure No. 17,643, pp. 26; Research Disclosure No. 18,716, pp. 651; Research Disclosure No. 307,105, pp. 873–874; and JP-A No. 64-13546.

The content of the water-soluble polymer in the toner-image receiving layer can be any suitable one set according to the purpose and is preferably from 0.5 $g/m^2$ to 2 $g/m^2$.

The thermoplastic resin can be used in combination with one or more other polymer materials. In this case, the thermoplastic resin should be generally contained in the layer in a greater amount than the other polymers.

The content of the thermoplastic resin in the toner-image receiving layer is preferably 10% by weight or more, more preferably 30% by weight or more, further preferably 50% by weight or more, and typically preferably form 50% by weight to 90% by weight.

Releasing Agent

The releasing agent is incorporated into the toner-image-receiving layer so as to prevent offset of the toner-image-receiving layer. Such releasing agents are not specifically limited and can be appropriately selected, as long as they are melted or fused by heating at an image-fixing temperature, are deposited on the surface of the toner-image-receiving layer and form a layer of the releasing agent on the surface by cooling and solidifying.

The releasing agent can be at least one of silicone compounds, fluorine compounds, waxes, and matting agents.

As the releasing agents, the compounds mentioned for example in "Properties and Applications of Waxes," Revised Edition, published by Saiwai Shobo, or The Silicon Handbook published by THE NIKKAN KOGYO SHIMBUN, may be used. Further, the silicon compounds, fluorine compounds or waxes used for the toners mentioned in JP-B Nos. 59-38581, 04-32380, Japanese Patents Nos. 2838498, 2949558, JP-A Nos. 50-117433, 52-52640, 57-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542 can also be used. Moreover, two or more sets of these compounds can be used.

Examples of the silicone compounds are silicone oils, silicone rubber, silicone fine particles, silicone-modified resins and reactive silicone compounds.

Such silicone oils include, for example, unmodified silicon oil, amino-modified silicone oil, carboxy-modified silicone oil, carbinol-modified silicone oil, vinyl-modified silicone oil, epoxy-modified silicone oil, polyether-modified silicone oil, silanol-modified silicone oil, methacrylic-modified silicone oil, mercapto-modified silicone oil, alcohol-modified silicone oil, alkyl-modified silicone oil, and fluorine-modified silicone oil.

Examples of the silicone-modified resins are silicone-modified resins derived from olefinic resins, polyester resins, vinyl resins, polyamide resins, cellulose resins, phenoxy resins, vinyl chloride-vinyl acetate resins, urethane resins, acrylic resins, styrene-acrylic resins, or copolymers comprising at least one of these constitutive monomers.

The fluorine compounds can be any suitable one according to the purpose, and examples thereof are fluorocarbon oils, fluoro rubber, fluorine-modified resins, fluorosulfonic acid compounds, fluorosulfonic acid, fluoric acid compounds or salts thereof, and inorganic fluorides.

The waxes are roughly classified as naturally-occurring waxes and synthetic waxes.

Preferred examples of the naturally-occurring waxes are vegetable waxes, animal waxes, mineral waxes, and petroleum waxes, of which vegetable waxes are typically preferred. As the naturally-occurring waxes, water-dispersible waxes are preferred for their good compatibility (miscibility) in the case where an aqueous resin is used as the polymer component in the toner-image receiving layer.

The vegetable waxes are not specifically limited and can be selected from known vegetable waxes such as synthesized products or commercially available products. Examples of the vegetable waxes are carnauba waxes, castor oil, rape oil, soybean oil, Japan tallow, cotton wax, rice wax, sugarcane wax, candelilla wax, Japan wax and jojoba oil.

The carnauba wax is commercially available under the trade names of, for example, EMUSTAR-0413 from Nippon Seiro Co., Ltd., and SELOSOL from Chukyo Yushi Co., Ltd. The caster oil is commercially available as, for example, a purified caster oil from Itoh Oil Chemicals Co., Ltd.

Among them, carnauba waxes having a melting point of 70° C. to 95° C. are preferred, since the resulting image-receiving material has excellent anti-offset properties and adhesion resistance, can pass through a machine smoothly, has good glossiness, invites less cracking and can form high-quality images.

The animal waxes can be any suitable ones, and examples thereof are beeswaxes, lanolin, spermaceti waxes, whale oils, and wool waxes.

The mineral waxes can be any suitable ones such as prepared products or commercially available products. Examples thereof are montan wax, montan ester wax, ozokerite, and ceresin.

Among them, montan waxes having a melting point of 70° C. to 95° C. are preferred, since the resulting image-receiving material has excellent anti-offset properties and adhesion resistance, can pass through a machine smoothly, has good glossiness, invites less cracking and can form high-quality images.

The petroleum waxes can be any suitable ones such as synthesized products or commercially available products, and examples thereof are paraffin wax, microcrystalline wax and petrolatum.

The content of the naturally-occurring wax in the toner-image-receiving layer is preferably from 0.1 $g/m^2$ to 4 $g/m^2$, and more preferably from 0.2 $g/m^2$ to 2 $g/m^2$.

When the content is less than 0.1 $g/m^2$, sufficient anti-offset properties and adhesion resistance may not be obtained. When it exceeds 4 $g/m^2$, the resulting images may decrease quality due to excessive wax.

To obtain satisfactory anti-offset properties and to allow the sheet to pass through a machine smoothly, the melting point of the naturally occurring wax is preferably from 70° C. to 95° C., and more preferably from 75° C. to 90° C.

The synthetic waxes are classified as synthetic hydrocarbons, modified waxes, hydrogenated waxes, and other fats and oil-derived synthetic waxes. These waxes are preferably water-dispersible waxes for their good miscibility with an aqueous thermoplastic resin, if any, in the toner image receiving layer.

Examples of the synthetic hydrocarbons are Fischer-Tropsch wax and polyethylene wax.

Examples of the oil-derived synthetic waxes are acid amide compounds such as stearamide, and acid imide compounds such as anhydrous phthalimide.

The modified waxes include, but are not limited to, amine-modified wax, acrylic acid-modified wax, fluorine-modified wax, olefin-modified wax, urethane-type wax, and alcohol-type wax.

The hydrogenated waxes include, but are not limited to, hard castor oil, castor oil derivatives, stearic acid, lauric acid, myristic acid, palmitic acid, behenic acid, sebacic acid, undecylenic acid, heptyl acids, maleic acid, high grade maleic oils.

The matting agents include various conventional matting agents. Solid particles for use in the matting agents can be classified as inorganic particles and organic particles. Specifically, inorganic matting agents may be oxides (for example, silicon dioxide, titanium oxide, magnesium oxide, aluminum oxide), alkaline earth metal salts (for example, barium sulfate, calcium carbonate, magnesium sulfate), silver halides (for example, silver chloride or silver bromide), and glass.

Examples of inorganic matting agents are given for example in German Patent No. 2529321, UK Patents Nos. 760775, 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

The above organic matting agent contains starch, cellulose ester (for example, cellulose-acetate propionate), cellulose ether (for example, ethyl cellulose) and a synthetic resin. It is preferred that the synthetic resin is insoluble or difficultly soluble. Examples of insoluble or difficultly soluble synthetic resins include poly(meth)acrylic esters, e.g., polyalkyl(meth)acrylate and polyalkoxyalkyl(meth) acrylate, polyglycidyl(meth)acrylate), poly(meth)acrylamide, polyvinyl esters (e.g., polyvinyl acetate), polyacrylonitrile, polyolefins (e.g., polyethylene), polystyrene, benzoguanamine resin, formaldehyde condensation polymer, epoxy resins, polyamides, polycarbonates, phenolic resins, polyvinyl carbazole and polyvinylidene chloride.

Copolymers which combine the monomers used in the above polymers, may also be used.

In the case of the above copolymers, a small amount of hydrophilic repeating units may be included. Examples of monomers which form a hydrophilic repeating unit are acrylic acid, methacrylic acid, α, β-unsaturated dicarboxylic acid, hydroxyalkyl(meth)acrylate, sulfoalkyl(meth)acrylate and styrene sulfonic acid.

Examples of organic matting agents are for example given in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, 57-14835.

Also, two or more types of solid particles may be used in combination as matting agents. The average particle size of the solid particles may conveniently be, for example, 1 μm to 100 μm, but is preferably 4 μm 30 μm. The usage amount of the solid particles may conveniently be 0.01 $g/m^2$ to 0.5 $g/m^2$, but is preferably 0.02 $g/m^2$ to 0.3 $g/m^2$.

To obtain satisfactory anti-offset properties and to allow the sheet to pass through a machine smoothly, the melting point of the releasing agent is preferably from 70° C. to 95° C., and more preferably from 75° C. to 90° C.

The releasing agents for use in the toner-image-receiving layer can also be derivatives, oxides, purified products, and mixtures of the aforementioned substances. These releasing agents may each have one or more reactive substituents.

The content of the releasing agent in the toner-image-receiving layer is preferably from 0.1% by weight to 10% by weight, more preferably from 0.3% by weight to 8.0% by weight, and further preferably from 0.5% by weight to 5.0% by weight based on the total weight of the toner-image receiving layer.

When the content is less than 0.1% by weight, the resulting medium may exhibit insufficient anti-offset performance and adhesion resistance. When it exceeds 10% by weight, the image quality may deteriorate due to excessive releasing agent.

Plasticizer

The plasticizers can be any of known plasticizers for resins. The plasticizers work to control the fluidizing or softening of the toner-image receiving layer by the action of heat and/or pressure applied upon fixation of the toner.

Typical disclosures of the plasticizers can be found in, for example, Kagaku Binran (Chemical Handbook), ed. by The Chemical Society of Japan, Maruzen Co., Ltd. Tokyo; Plasticizer, Theory and Application, edited and written by Koichi Murai and published by Saiwai Shobo; Volumes 1 and 2 of Studies on Plasticizer, edited by Polymer Chemistry Association; and Handbook on Compounding Ingredients for Rubbers and Plastics, edited by Rubber Digest Co.

Such plasticizers are also referred to as high-boiling point organic solvents and thermal solvents in some publications. Examples of the plasticizers are esters such as phthalic, phosphoric, fatty acids, abietic, adipic, sebacic, azelaic, benzoic, butyric, epoxidized fatty acids, glycolic, propionic, trimellitic, citric, sulfonic, carboxylic, succinic, maleic, fumaric, and stearic acid; amides including aliphatic amides and sulfonamides, ethers, alcohols, lactones, poly (ethylene oxide)s and compounds described in JP-A No. 59-83154, No. 59-178451, No. 59-178453, No. 59-178454, No. 59-178455, No. 59-178457, No. 62-174754, No. 62-245253, No. 61-209444, No. 61-200538, No. 62-8145, No. 62-9348, No. 62-30247, No. 62-136646, and No. 2-235694.

One or more of these plasticizers can be incorporated into the resin component.

Polymer plasticizers having a relatively low molecular weight can also be used herein. The molecular weight of such a plasticizer is preferably lower than that of a binder resin to be plasticized and is preferably 15000 or less, and more preferably 5000 or less. When these polymer plasticizers are used, those of the same kind with the resin to be plasticized are preferred. For example, low-molecular-weight polyesters are preferably used for plasticizing a polyester resin. In addition, oligomers can be used as the plasticizers.

In addition to the aforementioned compounds, the plasticizers are also commercially available under the trade names of, for example, Adekacizer PN-170 and PN-1430 from Asahi Denka Kogyo Co., Ltd.; PARAPLEX G-25, G-30 and G-40 from C. P. Hall Co.; Ester Gum 8L-JA, Ester R-95, Pentalin 4851, FK 115, 4820 and 830, Luisol 28-JA, Picolastic A75, Picotex LC and Crystalex 3085 from Rika Hercules Co.

The plasticizer can be freely used so as to mitigate stress and/or strain which may be caused when the toner particles are embedded in the toner-image-receiving layer. Such strain includes, for example, physical strain such as elastic force and viscosity, and strain due to material balance in, for example, molecules, principal chains and/or pendant moieties of the binder.

The plasticizer may be finely dispersed, may undergo micro-phase separation into islands-in-sea structure or may be sufficiently dissolved or miscible with other components such as a binder in the layers.

The content of the plasticizer in the toner-image-receiving layer is preferably from 0.001% to 90% by weight, more preferably from 0.1% to 60% by weight, and further preferably from 1% to 40% by weight.

The plasticizers can be used to control the slipping property (leading to the improvement in the transport performance due to friction reduction), improve the anti-offset property during fixing (detachment of toner or layers onto the fixing portion), control the curling balance, and control the charging property for a desirable latent toner image formation.

Coloring Agent

The coloring agent can be any suitable one according to the purpose, and examples thereof are fluorescent brightening agents, white pigments, colored pigments and dyes.

The above fluorescent brightening agent has absorption in the near-ultraviolet region, and is a compound which emits fluorescence at 400 nm to 500 nm. The various fluorescent brightening agents known in the art may be used without any particular limitation. As this fluorescent brightening agent, the compounds described in "The Chemistry of Synthetic Dyes" Volume V, Chapter 8 edited by K. VeenRataraman can conveniently be mentioned. The fluorescent brightening agent can be any commercially available product or synthesized product, and examples thereof are stilbene compounds, coumarin compounds, biphenyl compounds, benzo-oxazoline compounds, naphthalimide compounds, pyrazoline compounds and carbostyril compounds. Examples of these are white furfar-PSN, PHR, HCS, PCS, B from Sumitomo Chemicals, and UVITEX-OB from Ciba-Geigy.

The white pigment can be any suitable one selected according to the purpose, and examples thereof are inorganic pigments such as titanium dioxide and calcium carbonate.

Examples of the colored pigments include, but are not limited to, pigments, azo pigments, polycyclic pigments, condensed polycyclic pigments, lake pigments and carbon black as described in, for example, JP-A No. 63-44653.

Examples of the azo pigments are azo lakes such as carmine 6B and red 2B; insoluble azo pigments such as monoazo yellow, disazo yellow, pyrazolone orange, and Vulcan orange; and condensed azo compounds such as chromophthal yellow and chromophthal red.

Examples of the polycyclic pigments are phthalocyanine pigments such as copper phthalocyanine blue and copper phthalocyanine green.

Examples of the condensed polycyclic pigments are dioxazine pigments such as dioxazine violet; isoindolinone pigments such as isoindolinone yellow; threne pigments; perylene pigments; perinone pigments; and thioindigo pigments.

Examples of the lake pigments are malachite green, rhodamine B, rhodamine G, and Victoria blue B.

Examples of the inorganic pigments are oxides such as titanium dioxide and iron oxide red; sulfates such as precipitated barium sulfate; carbonates such as precipitated calcium carbonate; silicates such as hydrous silicates and anhydrous silicates; and metal powders such as aluminum powder, bronze powder, zinc powder, chrome yellow and iron blue.

Each of these can be used alone or in combination of two or more.

The dye can be any suitable one selected according to the purpose, and examples thereof are anthraquinone compounds and azo compounds. Each of these can be used alone or in combination.

Examples of water-insoluble dyes are vat dyes, disperse dyes and oil-soluble dyes. The vat dyes include, but are not limited to, C. I. Vat violet 1, C. I. Vat violet 2, C. I. Vat violet 9, C. I. Vat violet 13, C. I. Vat violet 21, C. I. Vat blue 1, C. I. Vat blue 3, C. I. Vat blue 4, C. I. Vat blue 6, C. I. Vat blue 14, C. I. Vat blue 20 and C. I. Vat blue 35. The disperse dyes include, but are not limited to, C. I. disperse violet 1, C. I. disperse violet 4, C. I. disperse violet 10, C. I. disperse blue 3, C. I. disperse blue 7 and C. I. disperse blue 58. The oil-soluble dyes include, but are not limited to, C. I. solvent violet 13, C. I. solvent violet 14, C. I. solvent violet 21, C. I. solvent violet 27, C. I. solvent blue 11, C. I. solvent blue 12, C. I. solvent blue 25 and C. I. solvent blue 55.

Colored couplers used in silver halide photography may also be used to advantage.

The amount ($g/m^2$) of coloring agent in the above toner-image-receiving layer is preferably 0.1 $g/m^2$ to 8 $g/m^2$, but more preferably 0.5 $g/m^2$ to 5 $g/m^2$.

When the amount of coloring agent is less than 0.1 $g/m^2$, the light transmittance in the toner-image-receiving layer is high, and when the amount of the above coloring agent exceeds 8 $g/m^2$, handling becomes more difficult due to cracks, and adhesion resistance.

The filler may be an organic or inorganic filler, and reinforcers for binder resins, bulking agents and reinforcements known in the art may be used. This filler may be selected by referring to "Handbook of Rubber and Plastics Additives" (ed. Rubber Digest Co.), "Plastics Blending Agents—Basics and Applications" (New Edition) (Taisei Co.) and "The Filler Handbook" (Taisei Co.).

As the filler, various inorganic fillers or inorganic pigments can be used. Examples of inorganic fillers or inorganic pigments are silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Silica and alumina are particularly preferred. One of these fillers may be used alone, or two or more may be used in combination. It is preferred that the filler has a small particle diameter. When the particle diameter is large, the surface of the toner-image-receiving layer tends to become rough.

Silica includes spherical silica and amorphous silica. The silica may be synthesized by the dry method, wet method or aerogel method. The surface of the hydrophobic silica particles may also be treated by trimethylsilyl groups or silicone. Colloidal silica is preferred. The silica is preferably porous.

Alumina includes anhydrous alumina and hydrated alumina. Examples of crystallized anhydrous aluminas which may be used are $\alpha$, $\beta$, $\gamma$, $\delta$, $\xi$, $\eta$, $\theta$, $\kappa$, $\rho$ or $\chi$. Hydrated alumina is preferred to anhydrous alumina. The hydrated alumina may be a monohydrate or trihydrate. Monohydrates include pseudo-boehmite, boehmite and diaspore. Trihydrates include gypsite and bayerite. Porous alumina is preferred.

The alumina hydrate can be synthesized by the sol-gel method wherein ammonia is added to an aluminum salt solution to precipitate alumina, or by hydrolysis of an alkali aluminate. Anhydrous alumina can be obtained by dehydrating alumina hydrate by the action of heat.

The amount of the filler is preferably 5 parts by weight to 2000 parts by weight relative to 100 parts by weight of the dry weight of the binder in the toner-image receiving layer.

A crosslinking agent can be blended in order to adjust the storage stability or thermoplastic properties of the toner-image-receiving layer. Examples of this crosslinking agent are compounds containing two or more reactive groups in the molecule such as epoxy, isocyanate, aldehyde, active halogen, active methylene, acetylene and other reactive groups known in the art.

The crosslinking agent may also be a compound having two or more groups which are able to form bonds such as hydrogen bonds, ionic bonds or coordination bonds.

The crosslinking agent may be a compound known in the art such as a resin coupling agent, curing agent, polymerizing agent, polymerization promoter, coagulant, film-forming agent or film-forming assistant. Examples of coupling agents are chlorosilanes, vinylsilanes, epoxisilanes, aminosilanes, alkoxyaluminum chelates, titanate coupling agents or other agents known in the art such as those mentioned in "Handbook of Rubber and Plastics Additives" (ed. Rubber Digest Co.).

The toner-image receiving layer preferably comprises a charge control agent for controlling the transfer and deposition of the toner and for preventing the deposition or adhesion of the toner-image receiving layer due to electrification.

The charge control agent can be any suitable one selected according to the purpose, and examples thereof are cationic surfactants, anionic surfactants, amphoteric surfactants, non-ionic surfactants, and polymer electrolytes or electroconducting metal oxides. Examples of the surfactants are cationic charge inhibitors such as quaternary ammonium salts, polyamine derivatives, cation-modified polymethylmethacrylate, cation-modified polystyrene; anionic charge inhibitors such as alkyl phosphates and anionic polymers; or non-ionic charge inhibitors such as fatty acid esters and polyethylene oxide.

When the toner is negatively charged, the charge control agent blended in the toner-image receiving layer is preferably cationic or nonionic.

Examples of electroconducting metal oxides are ZnO, $TiO_2$, $SnO_2$, $Al_2O_3$, $In_2O_3$, $SiO_2$, MgO, BaO and $MoO_3$. These electroconducting metal oxides may be used alone or in combination of two or more, or they may be used in the form of a complex oxide. Also, the electroconducting metal oxide may contain other elements (doping), for example ZnO may contain Al or In, $TiO_2$ may contain Nb or Ta, and $SnO_2$ may contain Sb, Nb or halogen elements (doping).

Other Additives

The materials used to obtain the toner-image-receiving layer of the present invention may also contain various additives to improve stability of the output image or improve stability of the toner-image-receiving layer itself. Examples of additives are known antioxidants, age resistors, degradation inhibitors, anti-ozone degradation inhibitors, ultraviolet light absorbers, metal complexes, light stabilizers or preservatives.

The antioxidants can be any suitable one selected according to the purpose and examples thereof are chroman compounds, coumarane compounds, phenol compounds (e.g., hindered phenols), hydroquinone derivatives, hindered amine derivatives and spiroindan compounds. Antioxidants are given in JP-A No. 61-159644.

The age resistors can be any suitable one selected according to the purpose and examples thereof are given in "Handbook of Rubber and Plastics Additives," Second Edition (1993, Rubber Digest Co.), p 76–121.

The ultraviolet light absorbers can be any suitable one selected according to the purpose and examples thereof are benzotriazo compounds (U.S. Pat. No. 3,533,794), 4-thiazolidone compounds (U.S. Pat. No. 3,352,681), benzophenone compounds (JP-A No. 46-2784) and ultraviolet light absorbing polymers (JP-A No. 62-260152).

The metal complexes can be any suitable one selected according to the purpose and examples thereof are given in U.S. Pat. Nos. 4,241,155, 4,245,018, and 4,254,195; and JP-A Nos. 61-88256, 62-174741, 63-199248, 01-75568, and 01-74272.

Ultraviolet absorbers and optical stabilizers described in Handbook on Compounding Ingredients for Rubbers and Plastics, revised second edition, p. 122–137 (1993), Rubber Digest Co. can also be used.

The 180-degree peel strength of the toner-image-receiving layer with a fixing member is preferably 0.1 N/25-mm or less, and more preferably 0.041 N/25-mm or less at an image-fixing temperature. The 180-degree peel strength can be determined according to a method specified in JIS K 6887 using a surface material of the fixing member.

It is preferred that the toner-image-receiving layer has a high degree of whiteness. This whiteness is measured by the method specified in JIS P 8123, and is preferably 85% or more. It is preferred that the spectral reflectance is 85% or more in the wavelength region of 440 nm to 640 nm, and that the difference between the maximum spectral reflectance and minimum spectral reflectance in this wavelength range is within 5%. Further, it is preferred that the spectral reflectance is 85% or more in the wavelength region of 400 nm to 700 nm, and that the difference between the maximum spectral reflectance and minimum spectral reflectance in this wavelength range is within 5%.

Specifically, regarding the whiteness, the L* value is preferably 80 or higher, preferably 85 or higher and still more preferably 90 or higher in a CIE 1976 (L*a*b*) color space. The tone of the white color should preferably be as neutral as possible. Regarding the whiteness tone, the value of $(a^*)^2+(b^*)^2$ is preferably 50 or less, more preferably 18 or less and still more preferably 5 or less in an (L*a*b*) space.

It is preferred that the toner-image-receiving layer has a high smoothness. The arithmetic mean roughness (Ra) is preferably 3 μm or less, more preferably 1 μm or less and still more preferably 0.5 μm or less over the whole range from white where there is no toner, to black where there is the maximum density.

Arithmetic mean roughness may be measured based on JIS B 0601, B 0651 and B 0652.

The thickness of the electrophotographic image receiving sheet is not specifically limited and is preferably from 50 μm to 550 μm and more preferably from 100 μm to 350 μm.

<Transfer Unit>

The transfer unit is a unit for transferring the visible image to the electrophotographic image receiving roll or the electrophotographic image receiving sheet. The transfer unit can be any suitable one selected according to the purpose and can be a conventional image forming apparatus. The transfer unit is preferably so configured that the toner image (visible image) is primarily transferred to an intermediate image transfer member and is then secondarily transferred to the electrophotographic image receiving sheet (or roll). More preferably, using toners of two or more colors, preferably full-color toners as the toner, the visible image is primarily transferred to the intermediate image transfer member to form a composite transferred image in a primary image transfer process, and the composite transferred image is secondarily transferred to the electrophotographic image receiving sheet (or roll) in a secondary image transfer process.

The transfer can be realized for example by charging the latent electrostatic image bearing member (photoconductor) using a transfer charger, which can be performed by the transfer unit. The transfer unit comprises a first transfer unit which transfers the visible image to the intermediate image transfer member to form a composite transferred image, and a second transfer unit which transfers this composite transferred image to the electrophotographic image receiving sheet.

The intermediate image transfer member is not particularly limited and may be suitably selected from transfer bodies known in the art, for example, a transfer belt.

The transfer unit (the first transfer unit and the second transfer unit), preferably comprises at least an image-transferer which charges by releasing the visible image formed on the latent electrostatic image bearing member (photo conductor) to the electrophotographic image receiving sheet's side. There may be one, two or more of the transfer units.

The image-transferer may be a corona transfer unit which functions by corona discharge, a transfer belt, a transfer roller, a pressure transfer roller or an adhesion transfer unit.

The primary image fixing process is a process for fixing the visible image transferred to the electrophotographic image receiving sheet using an image-fixing device. This process can be carried out every time when a toner image of each color is transferred to the electrophotographic image receiving sheet or carried out at once after all the color toner images are transferred to and overlaid upon the sheet.

The fixing apparatus is not particularly limited and may be suitably selected from a heating-and-pressing unit known in the art. Examples of the heating-and-pressing unit are a combination of a heat roller and a pressure roller.

The heating by the heating-and-pressing unit is preferably heating to 80° C. to 200° C.

The image forming apparatus according to an aspect of the present invention will be illustrated with reference to FIG. 3.

Figure 3:
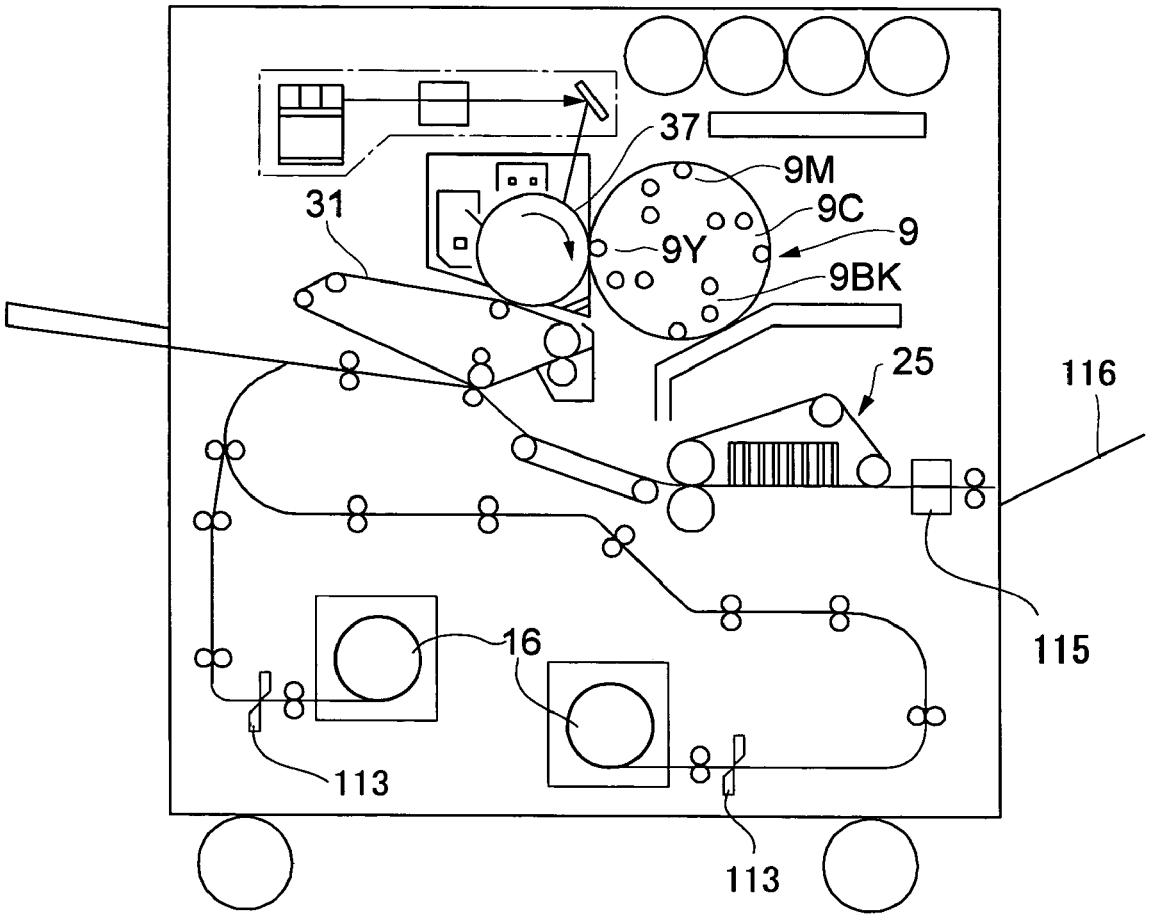
FIG. 3 is a schematic diagram of an image forming apparatus, according to an aspect of the present invention.

The image forming apparatus of FIG. 3 includes a photoconductive drum 37 serving as the latent electrostatic image bearing member, a developing unit 9 serving as the developing unit, an intermediate image transfer member 31, an electrophotographic image receiving sheet roll 16, a unit 25 for image smoothing and fixing, an X-Y cutter 115, and a roll cutter 113. The unit 25 for image smoothing and fixing is preferably a device shown in FIG. 5.

The intermediate image transfer member 31 is an endless belt and is spanned movably around rollers inside thereof. In the vicinity of the intermediate image transfer member 31 is arranged a cleaner having a cleaning blade.

The developing unit 9 includes a black developing unit 9BK, a yellow developing unit 9Y, a magenta developing unit 9M and a cyan developing unit 9C.

In the image forming apparatus of FIG. 3, for example, a charger roller uniformly charges the photoconductive drum 37. A light irradiator exposes light imagewise to the photoconductive drum 37 to thereby form a latent electrostatic image. The latent electrostatic image formed on the photoconductive drum 37 is developed with a toner fed from the developing unit 9 to thereby form a visible image (toner image). The visible image (toner image) is primarily transferred to the intermediate image transfer member 31 by the action of a voltage applied by a roller and is then secondarily transferred to the electrophotographic image receiving sheet 16 to thereby form a transferred image thereon. Residual toner on the photoconductive drum 37 is removed by the cleaner, and the charge of the photoconductive drum 37 is once eliminated by a charge-eliminating lamp.

Figure 4:
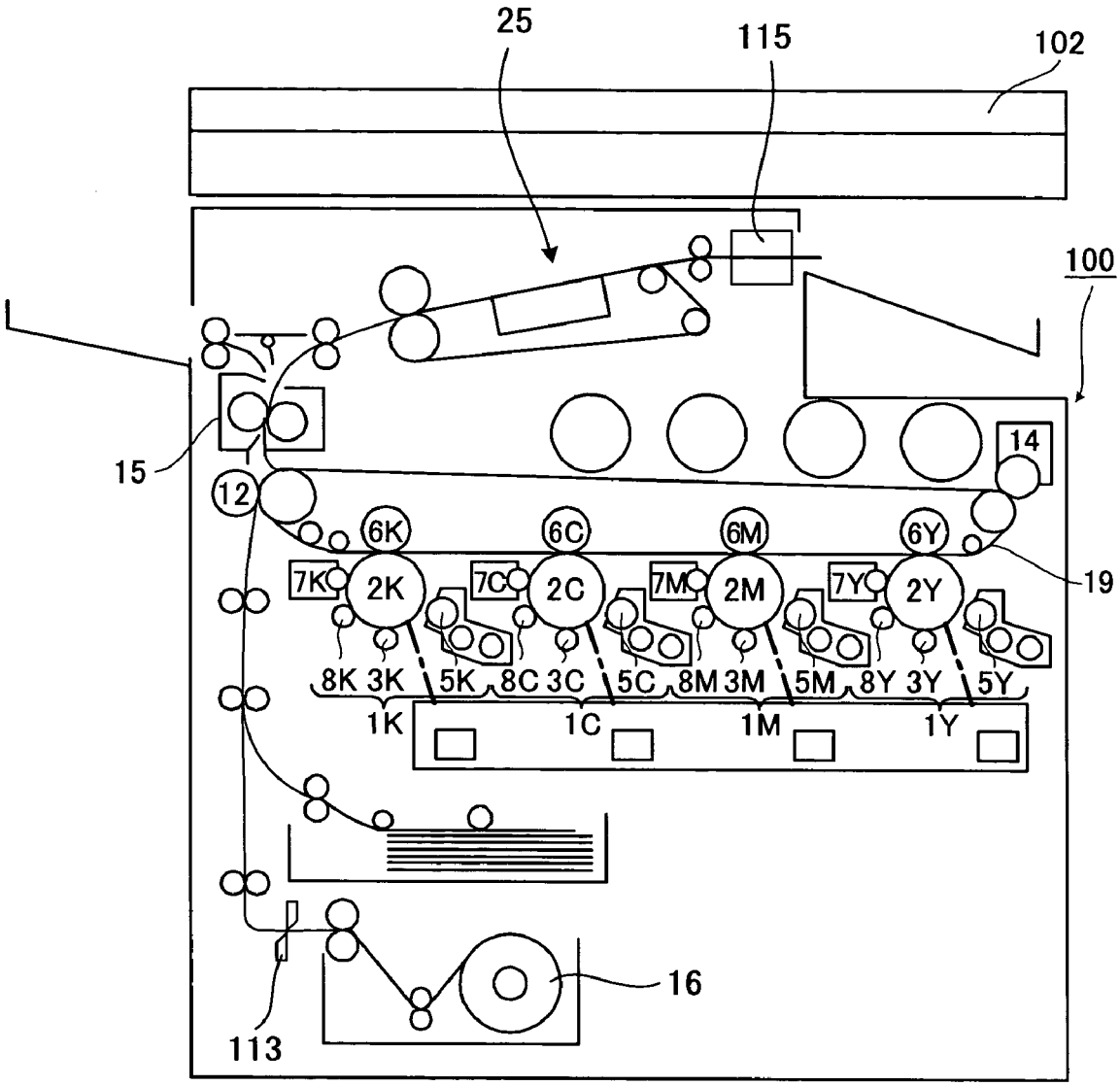
FIG. 4 is a schematic diagram of a tandem color copier (image forming apparatus) which enables high-speed recording.

FIG. 4 is a schematic diagram of a tandem color copier (image forming apparatus) which enables high-speed recording. The image forming apparatus comprises a main body 100 and an image reader (document reading unit) 102. The main body 100 houses an image output section, a unit 25 for image smoothing and fixing serving as the secondary image-fixing unit, an electrophotographic image receiving roll 16, an X-Y cutter 115, and a roll cutter 113. The image output section comprises a first image-fixing device (first image-fixing unit) 15 and an image forming unit. The unit 25 for image smoothing and fixing (second image fixing unit) is preferably the device shown in FIG. 5.

The image forming unit comprises an endless intermediate image transfer belt 19 which is spanned over plural tension rollers and is rotated, electrophotographic image forming units 1Y, 1M, 1C, and 1K forming toner images, respectively of yellow, magenta, cyan and black arranged from upstream to downstream in the rotary direction of the image transfer belt 19, a belt cleaner 14 facing the intermediate image transfer belt 19, a secondary image transfer roller 12 facing the intermediate image transfer belt 19, a pair of conveyer rollers, a pair of resist rollers, a pair of first ejection rollers, a pair of second ejection rollers, and a second paper output tray.

The individual image forming units 1Y, 1M, 1C and 1K comprise, for example, photoconductive drums 2Y, 2M, 2C and 2K, chargers 3Y, 3M, 3C and 3K, developing units 5Y, 5M, 5C and 5K, primary image transfer rollers 6Y, 6M, 6C and 6K, photoconductor cleaners 7Y, 7M, 7C and 7K, charge eliminators 8Y, 8M, 8C and 8K, respectively.

In the image forming apparatus of FIG. 4, pieces of image information on black, yellow, magenta and cyan are transmitted to the respective image forming units (black, yellow, magenta and cyan image forming units 1K, 1Y, 1M and 1C) in the tandem image forming apparatus to thereby form black, yellow, magenta and cyan toner images in the respective image forming units. More specifically, the image forming unit (black, yellow, magenta and cyan image forming units 1K, 1Y, 1M and 1C) in the tandem image forming apparatus respectively have chargers 3 for uniformly charging the photoconductors 2 (black photoconductor 2K, yellow photoconductor 2Y, magenta photoconductor 2M and cyan photoconductor 2C); light irradiators for applying light imagewise to the photoconductor based on the respective pieces of color image information to thereby form a latent electrostatic image of each color on the photoconductor; developing units 5 for developing the latent electrostatic image using respective color toners (black, yellow, magenta and cyan) to thereby form respective color toner images; a charger 3 for transferring the toner image to the intermediate image transfer member 19; photoconductor cleaners 7; and charge eliminators 8. Thus, images of respective monochrome colors (black, yellow, magenta and cyan images) can be formed based on the respective pieces of color information. The thus formed black, yellow, magenta and cyan images respectively on the black, yellow, magenta and cyan photoconductors 2K, 2Y, 2M and 2C are sequentially transferred (primarily transferred) to the intermediate image transfer member 19 rotated and moved by the support roller. Thus, a composite color image (color transferred image) comprising the superimposed black, yellow, magenta and cyan images is formed on the intermediate image transfer member 19.

<Unit for Image Smoothing and Fixing>

The unit for image smoothing and fixing is a unit for smoothing and fixing the transferred image on the electrophotographic image receiving roll or the electrophotographic image receiving sheet, to thereby form a series of electrophotographic prints or an electrophotographic print. Examples of the unit for image smoothing and fixing are (1) unit by which the transferred image is heated and pressurized using a unit for image smoothing and fixing containing a heating-pressing member, a belt member and a cooling device, and then the electrophotographic image receiving sheet is cooled and peeled off from the belt member, and (2) unit by which a transparent toner containing a thermoplastic resin is applied to the toner image on the electrophotographic image receiving sheet which is formed with a visible image, the transferred image covered with the transparent toner is then heated and pressurized using a unit for image smoothing and fixing containing a heating-pressing member, a belt member and a cooling device, and then the electrophotographic image receiving sheet is cooled and peeled off from the belt member.

Figure 5:
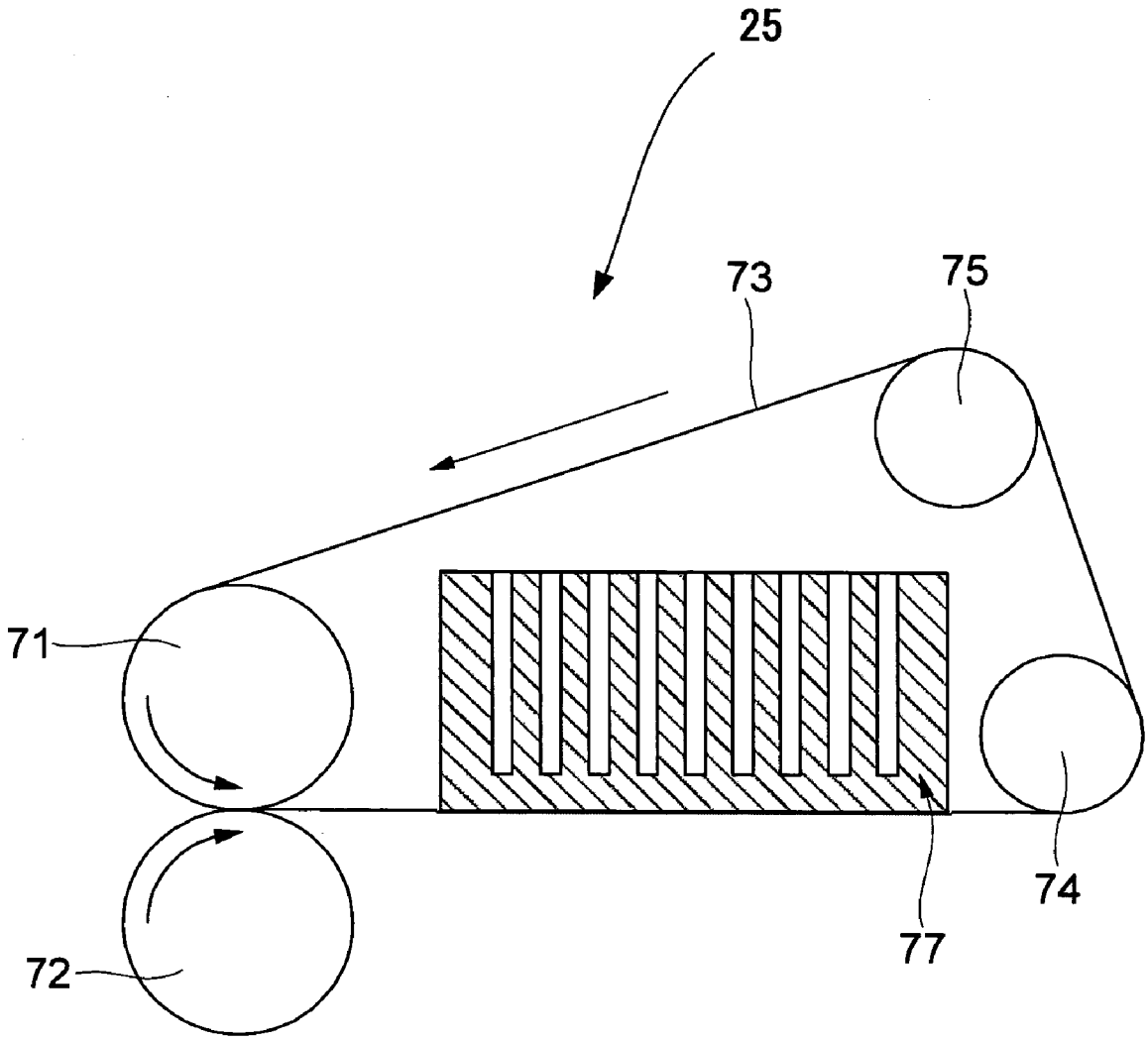
FIG. 5 is a schematic diagram showing an image smoothing and fixing unit for use in the present invention.

The unit for image smoothing and fixing can be any suitable one according to the purpose and is preferably the unit for image smoothing and fixing (belt image-fixing unit) of FIG. 5.

With reference to FIG. 5, the image smoothing and fixing unit comprises a heating roller 71, a releasing roller 74, a tension roller 75, an endless belt 73, and a pressing roller 72 pressed to the heating roller 71 with the interposition of the endless belt 73. The endless belt 73 is rotatably supported by the heating roller 71, the releasing roller 74, and the tension roller 75.

A cooling heatsink 77 is arranged inside the endless belt 73 between the heating roller 71 and the releasing roller 74. The cooling heatsink 77 works to forcedly cool the endless belt 73 and constitutes a sheet cooling and conveying section for cooling and conveying the electrophotographic image-receiving sheet.

In the image smoothing and fixing unit 25 as shown in FIG. 5, an electrophotographic image-receiving sheet bearing a transferred color toner image on its surface is introduced into a nip so that the color toner image faces the heating roller 71. The nip is a portion at which the heating roller 71 is pressed to the pressure roller 72 with the interposition of the endless belt 73. When the electrophotographic image-receiving sheet passes through the nip between the heating roller 71 and the pressure roller 72, the color toner image T is heated, fused and thereby fixed on the electrophotographic image-receiving sheet.

Subsequently, the toner is substantially heated to a temperature of about 120° C. to about 130° C. in the nip between the heating roller 71 and the pressure roller 72 and is thereby fused and fixed to the image-receiving layer of the electrophotographic image-receiving sheet. The electrophotographic image-receiving sheet bearing the color toner image on its image-receiving layer is then conveyed with the endless belt 73 while its surface image-receiving layer is in intimate contact with the surface of the endless belt 73. During the conveying, the endless belt 73 is forcedly cooled by the cooling heatsink 77 to thereby cool and solidify the color toner image and the image-receiving layer, and the electrophotographic image-receiving sheet is then separated or peeled off from the endless belt 73 due to its own rigidity by the action of the releasing roller 74.

Residual toners and other unnecessary substances on the surface of the endless belt 73 are removed by a cleaner (not shown) for another image-fixing process after the completion of the releasing process.

On the surface of the endless belt (belt member), it is preferred to form a thin film comprising at least one material selected from silicone rubber, fluorinated rubber, silicone resin and fluorinated resin. Of these, it is preferred to provide a layer of fluorocarbon siloxane rubber of uniform thickness on the surface of the endless belt, or provide a layer of silicone rubber of uniform thickness on the surface of the endless belt and then provide a layer of fluorocarbon siloxane rubber on the surface of the silicone rubber.

It is preferred that the fluorocarbon siloxane rubber has a perfluoroalkyl ether group and/or a perfluoroalkyl group in the principal chain.

As the fluorocarbon siloxane rubber, a curing material comprising a fluorocarbon siloxane rubber composition containing the components (A)–(D) below are preferred.

Component (A): a fluorocarbon polymer having, as its principal component, a fluorocarbon siloxane of the following structural formula (1) below, and containing aliphatic unsaturated groups, Component (B): at least one of organopolysiloxane and fluorocarbonsiloxane having two or more ≡SiH groups per molecule in a content of one to four times by mole the amount of the aliphatic unsaturated group in the fluorocarbonsiloxane rubber composition, Component (C): a filler, and Component (D): an effective amount of catalyst.

The fluorocarbon polymer of the component (A) comprises, as its principal component, a fluorocarbon siloxane containing a repeating unit represented by the following structural formula (1), and contains aliphatic unsaturated groups.

(1)

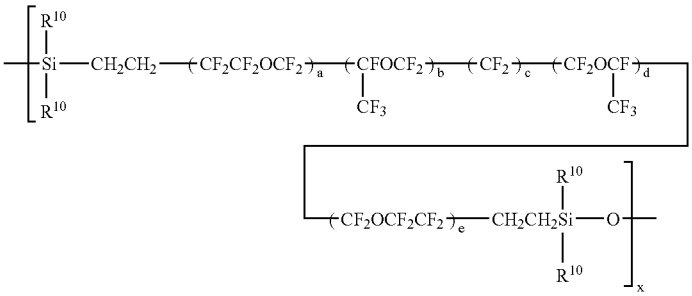

In the structural formula (1), $R^{10}$ is an unsubstituted or substituted monovalent hydrocarbon group preferably having 1 to 8 carbon atoms. The monovalent hydrocarbon group is preferably an alkyl group having 1 to 8 carbon atoms or an alkenyl group having 2 or 3 carbon atoms, of which a methyl group is typically preferred. The repetition numbers a and e are each an integer of 0 or 1, b and d are each an integer of 1 to 4, c is an integer of 0 to 8, and x is an integer of 1 or more, and is preferably an integer of 10 to 30.

An example of the above component (A) is the substance shown by the following structural formula (2):

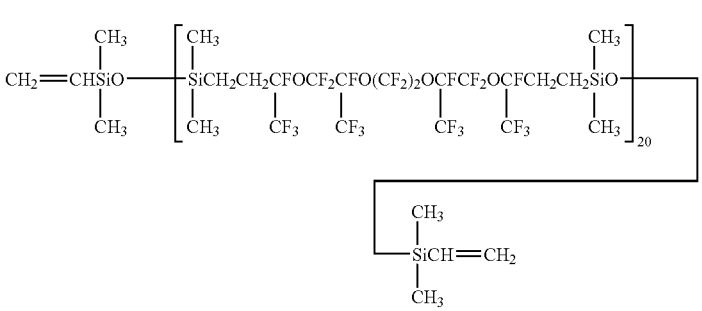

(2)

In the component (B), one example of the organopolysiloxane comprising ≡SiH groups is an organohydrogenpolysiloxane having at least two hydrogen atoms bonded to silicon atoms in the molecule.

In the fluorocarbon siloxane rubber composition for use in the present invention, when the fluorocarbon polymer of the component (A) comprises an aliphatic unsaturated group, the above organohydrogenpolysiloxane may be used as a curing agent. Specifically, in this case, the cured product is formed by an addition reaction between aliphatic unsaturated groups in the fluorocarbon siloxane, and hydrogen atoms bonded to silicon atoms in the organohydrogenpolysiloxane.

Examples of the organohydrogenpolysiloxanes are the various organohydrogenpolysiloxanes used in addition curing silicone rubber compositions.

The organohydrogenpolysiloxane is preferably contained so that the number of ≡SiH groups therein is at least one, relative to one aliphatic unsaturated hydrocarbon group in the fluorocarbon siloxane of the component (A) and more preferably one to five ≡SiH groups are contained therein.

It is preferred that in the fluorocarbon containing ≡SiH groups, one unit of the structural formula (1) or $R^{10}$ in the structural formula (1) is a dialkylhydrogensiloxane group, the terminal group is a ≡SiH group such as dialkylhydrogensiloxane group or silyl group, and it can be represented by the following structural formula (3).

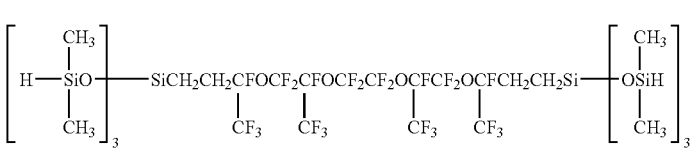

(3)

The filler which is the component (C) may be various fillers used in ordinary silicone rubber compositions. Examples are reinforcing fillers such as for example mist silica, precipitated silica, carbon powder, titanium dioxide, aluminum oxide, quartz powder, talc, sericite and bentonite, or fiber fillers such as asbestos, glass fiber and organic fibers or the like.

Examples of the catalyst which is the component (D) are chloroplatinic acid which is known in the art as an addition reaction catalyst, alcohol-modified chloroplatinic acid, complexes of chloroplatinic acid and olefins, platinum black or palladium supported on a carrier such as alumina, silica or carbon, and Group VIII elements of the Periodic Table or their compounds such as complexes of rhodium and olefins, chlorotris(triphenylphosphine) rhodium (Wilkinson catalyst) and rhodium (III) acetyl acetonate, and it is preferred to dissolve these complexes in an alcohol, ether or a hydrocarbon solvent.

The fluorocarbonsiloxane rubber composition for use herein may further comprise various additives or compounding agents within ranges not deteriorating the chemical resistance. For example, dispersing agents such as diphenylsilane diol, low polymer chain end hydroxyl group-blocked dimethylpolysiloxane and hexamethyl disilazane, heat resistance improvers such as ferrous oxide, ferric oxide, cerium oxide and octyl acid iron, and coloring agents such as pigments or the like, may be added as necessary.

The belt member is obtained by coating the surface of a heat resistant resin or metal belt with the above fluorocarbon siloxane rubber composition, and heat curing it, but the composition may, when necessary, be diluted to form a coating solution with a solvent such as m-xylene hexafluoride or benzotrifluoride which is then applied by an ordinary coating method such as spin coating, dip coating or knife coating. The heat curing temperature and time can be conveniently selected, but the selection is generally made, according to the belt type and manufacturing method, within the ranges of 100° C. to 500° C. and 5 seconds to 5 hours.

The thickness of the fluorocarbonsiloxane rubber layer arranged on the surface of the belt member is not specifically limited, and is preferably from 20 μm to 500 μm, and more preferably from 40 μm to 200 μm.

To effectively form an image having high surface smoothness and satisfactory glossiness, the surface roughness [arithmetic mean roughness Ra] of the belt member is preferably 20 μm or less, more preferably 5 μm or less, and further preferably 1 μm or less. The surface roughness Ra can be determined according to JIS B 0601, JIS B 0651, and JIS B 0652.

Image Smoothing and Fixing Using Transparent Toner

In the image smoothing and fixing procedure, a transparent toner containing a thermoplastic resin is applied to the toner image on the electrophotographic image receiving sheet (or roll), the toner image covered with the transparent toner is heated and pressurized by a unit for image smoothing and fixing having a heating-pressing member, a belt member and a cooling device, and electrophotographic image receiving sheet is cooled and peeled off from the belt member. According to this procedure, the image can be smoothed and fixed even when the electrophotographic image receiving sheet does not have a thermoplastic resin layer.

The transparent toner comprises at least a thermoplastic binder resin.

The transparent toner for use herein comprises toner particles that do not contain coloring materials for optical absorption or optical scattering, such as colored pigments, colored dyes, black carbon particles and black magnetic particles.

The transparent toner may have somewhat low optical transparency in some types or at some amounts of a fluidizing agent and releasing agent contained therein but is substantially colorless and optically transparent.

The binder resin can be any suitable one that is substantially optically transparent, and examples thereof are conventional resins for use in toners, such as polyester resins, polystyrene resins, polyacrylic resins, other vinyl resins, polycarbonate resins, polyamide resins, polyimide resins, epoxy resins, polyurea resins and other resins, and copolymers comprising any of these constitutive monomers. Among them, polyester resins are preferred for satisfactory toner properties such as image-fixing properties at low temperatures, image-fixing strength and storage stability. For higher image-fixing rate and lower image-fixing temperature, the binder resin preferably has a weight-average molecular weight of 5000 to 40000 and a glass transition point of 55° C. or higher and less than 75° C.

The flowability and chargeability of the transparent toner are preferably controlled so as to provide high and uniform glossiness. From this viewpoint, inorganic fine particles and/or organic fine particles are preferably externally added or applied to the surface of the transparent toner.

The inorganic fine particles can be any suitable one that does not adversely affect the advantages of the present invention. Examples thereof are fine particles comprising silica, titanium dioxide, tin oxide, and molybdenum oxide. For further stable electrostatic properties, these inorganic fine particles may be subjected to hydrophobing treatment with, for example, a silane coupling agent or a titanium coupling agent.

The organic fine particles can be any suitable one that does not adversely affect the advantages of the present invention. Examples thereof are fine particles comprising polyester resins, polystyrene resins, polyacrylic resins, vinyl resins, polycarbonate resins, polyamide resins, polyimide resins, epoxy resins, polyurea resins, and fluorocarbon resins.

The inorganic fine particles and organic fine particles preferably have an average particle diameter of 0.005 μm to 1 μm. When inorganic or organic fine particles having an average particle diameter of less than 0.005 μm are applied to the transparent toner, they may aggregate, thus failing to yield desired advantages. When the average particle diameter exceeds 1 μm, the resulting images may not have high glossiness.

The transparent toner preferably further comprises a releasing agent such as a wax. The wax can be any suitable one that does not adversely affect the advantages of the present invention and is selected from conventional materials used as wax. Examples thereof are polyethylene resin wax and carnauba naturally-occurring wax. The wax preferably has a melting point of 80° C. to 110° C. The content thereof in the transparent toner is preferably 2% by weight or more and less than 8% by weight. A wax having a melting point of lower than 80° C. may not impart sufficient flowability to the toner at room temperature. A wax having a melting point exceeding 110° C. may not be sufficiently fused at low temperature. When the content of the wax is less than 2% by weight, the wax may not work sufficiently. When it is 8% by weight or more, the toner may have deteriorated flowability and/or chargeability.

The diameter of the transparent toner is not specifically limited and may be, for example, about 15 μm.

The transparent toner can be used as a two-component developer in combination with any suitable carrier known in the art. Alternatively, the transparent toner can be used as one-component developer that works to undergo friction electrification with a developing sleeve or charger member to thereby form a charged toner and to develop a visible image in accordance with the latent electrostatic image.

To smooth and fix the color toner image using the transparent toner, a transparent toner image is developed in the developing unit that houses the transparent toner in addition to the color toners, and the transparent toner image is then transferred to the electrophotographic image receiving sheet simultaneously with or subsequently to the transfer of the color toner image.

Figure 6:
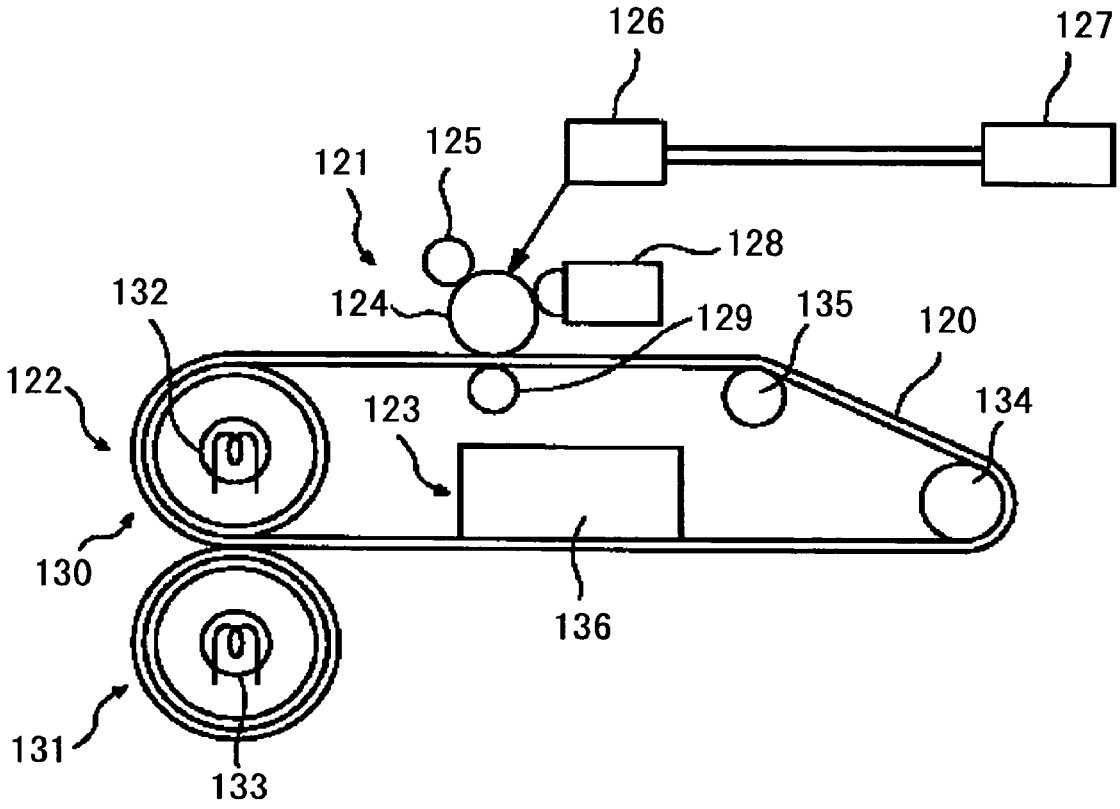
FIG. 6 is a schematic diagram showing another image smoothing and fixing unit for use in the present invention, in which a transparent toner is used for smoothing and glossing over an image.

By using a unit for image smoothing and fixing (belt image-fixing unit) shown in FIG. 6, the application of the transparent toner to the color toner image and the image smoothing and fixing procedure can be carried out simultaneously in one unit.

The unit for image smoothing and fixing of FIG. 6 includes an endless-belt-shaped transparent toner image bearing member 120; a unit 121 for forming a desired transparent toner image on the transparent toner image bearing member 120; a heating and pressing unit 122 for heating, pressing and bringing into contact between the transparent toner image and the color image on the transparent toner image bearing member 120 to thereby form a fixed color image covered with the transparent toner image; and a cooling unit 123 for cooling the electrophotographic image receiving sheet bearing the fixed and covered color toner image. Also shown in FIG. 6 are a rotary roller 134, a support roller 135, and a heat sink 136.

The transparent toner image bearing member 120 can be an endless image-fixing belt made of a polymer film such as a polyimide. To stably and uniformly form the transparent toner image, the transparent toner image bearing member 120 preferably has an electric resistance controlled to a certain value, for example, by dispersing electrically conductive additive such as electrically conductive carbon particles and electrically conductive polymers into the member.

The transparent toner image bearing member 120 may be a sheet but is preferably an endless belt. For better releasing property, the endless-belt-shaped transparent toner image bearing member 120 is preferably coated with at least one of silicone resins and fluorocarbon resins. The transparent toner image bearing member 120 preferably has a glossiness of 60 or more as determined with a 75-degree glossimeter for better flatness or smoothness.

The transparent toner image forming unit 121 works to form a transparent toner image containing a thermoplastic resin on the transparent toner image bearing member 120. The transparent toner image forming unit 121 can be any one comprising a conventional developing unit that can work this function. For example, the transparent toner image forming unit can be a unit which is so configured that a counter electrode member such as a roller being grounded or applied with a bias voltage is arranged in contact with the backside of the transparent toner image bearing member, a developing unit for one-component or two-component developer is arranged so as to face the counter electrode member and develops a transparent toner image directly onto the transparent toner image bearing member. The temperature of the transparent toner image bearing member at the position of the transparent toner developing unit is preferably 60° C. or lower.

The transparent toner image forming unit 121 is preferably a unit shown in FIG. 6. The transparent toner image forming unit 121 includes a photoconductive drum 124; a charger 125 facing the photoconductive drum 124; a light irradiator 126 comprising an ROS (rater optical scanner) or an LED array and working to apply light to the photoconductive drum 124; a unit 127 for forming signals to control the transparent toner image and to control the area of the transparent toner image on the color toner image and/or the amount of the transparent toner image; a transparent toner image developing unit 128 facing the photoconductive drum 124; and a transfer unit 129 for transferring the transparent toner image from the photoconductive drum 124 to the transparent toner image bearing member 120.

The photoconductive drum 124 can be any suitable one and may have a single layer or multilayer structure. In the latter case, the photoconductive drum 124 may have respective separated functions in respective layers. The material of the photoconductive drum 124 may be an inorganic material such as selenium, amorphous silicon, an organic material, and the like.

The charger 125 may be of contact electrification system using, for example, an electrically conductive or semiconductive roller, brush, film or rubber blade; or of corotron electrification or scorotron electrification using corona discharge.

The light irradiator 126 can be any suitable light irradiator such as a laser raster optical scanner (laser ROS) comprising a semiconductor laser, a scanner and an optical system, as well as an LED head or a halogen lamp. Among them, the laser ROS or LED head is preferred, since the area of an exposed image, i.e., the position of the sheet or roll to be covered with the transparent toner image can be arbitrarily controlled.

The unit 127 for forming signals to control the transparent toner image can be any suitable unit or member that can develop the transparent toner image at a desired position on the sheet or roll. The unit 127 may be so configured as to form signals for forming the transparent toner image based on image data outputted from an image processor.

The transparent toner image developing unit 128 can be any suitable developing unit for one-component system or two-component system which is capable of forming a uniform transparent toner image on the photoconductive drum 124. The transparent toner image developing unit 128 uses the transparent toner to be described afterward.

The transfer unit 129 can be any suitable unit. Examples thereof are a unit by which an electric field is formed between the photoconductive drum 124 and the transparent toner image bearing member 120 typically using an electrically conductive or semiconductive roller, brush, film or rubber blade under the application of a voltage to thereby transfer charged particle of transparent toner; and a unit by which the backside of the transparent toner image bearing member 120 is charged by corona discharge typically using a corotron charger or scorotron charger to thereby transfer charged particle of transparent toner.

The heating and pressing unit 122 can be any suitable heating-pressing member that is capable of heating, pressing and bringing into contact the transparent toner image bearing member 120 bearing the transparent toner image and the electrophotographic image receiving sheet bearing the color toner image. For example with reference to FIG. 6, the heating and pressing unit 122 has a pair of rollers 130 and 131. The rollers 130 and 131 are driven at a specific speed, interpose therebetween the transparent toner image bearing member 120 bearing the transparent toner image and the electrophotographic image receiving sheet bearing the color toner image, and convey, heat and pressurize these members. The rollers 130 and 131 are arranged in contact with each other under pressure, and at least one of them is heated at its surface to a temperature at which the transparent toner fuses. The rollers 130 and 131 preferably have heat sources 132 and 133 respectively at the center for the heating. It is preferred that at least one of the rollers 130 and 131 has a silicone rubber layer or fluorocarbon rubber layer on its surface and has a length of nip to be heated and pressurized of about 1 mm to about 8 mm.

<Unit for Removing Print Borders>

The image forming apparatus according to the first embodiment includes the unit for removing print borders. The unit for removing print borders is a unit for cutting borders of the electrophotographic print.

The unit for cutting print borders is preferably an X-Y cutter. Such an X-Y cutter is capable of removing borders in X-Y directions (longitudinal and transverse directions) of the electrophotographic print to thereby produce a borderless print.

The print borders can be cut by any suitable process according to the purpose. Examples thereof are (1) a process of cutting borders in a longitudinal direction with a roller cutter and cutting borders in a width direction (transverse direction) with a guillotine cutter; (2) a process of cutting borders in a longitudinal direction with a roller cutter, turning the sheet, and cutting borders in a width direction with the roller cutter; and (3) a process of punching a roll of the electrophotographic image receiving sheets by pressing from at least one of above or below the sheets. In the process (3), plural frames of prints may be punched in one step.

<Unit for Cutting Prints and Removing Print Borders>

The image forming apparatus according to the second embodiment includes the unit for cutting prints and removing print borders. The unit for cutting prints and removing print borders is a unit for cutting a series of electrophotographic prints into electrophotographic prints of a specific size.

In the unit for cutting prints and removing print borders, a series of electrophotographic prints are cut into electrophotographic prints, and simultaneously or thereafter, borders of the electrophotographic prints in X- and Y-directions (longitudinal and transverse directions) are removed to thereby produce borderless prints.

The unit for cutting prints and removing print borders is preferably an X-Y cutter as in the unit for removing print borders.

<Unit for Rewinding a Roll>

The image forming apparatus according to the second embodiment includes the unit for rewinding a roll. The unit for rewinding a roll is unit for rewinding an electrophotographic image receiving roll on which an image is not formed for another usage.

The unit for rewinding a roll can be any suitable one according to the purpose. A preferred example thereof is a roll rewinding mechanism comprising a supply reel that works to supply the electrophotographic image receiving roll and is capable of reciprocally rotating; driving unit for driving and rotating the supply reel reciprocally; and a sensor for detecting the tip of the electrophotographic image receiving roll.

The roll rewinding mechanism works as follows. The driving unit starts to thereby reciprocally rotate the supply reel at the time when an electrophotographic print at the tip of the electrophotographic image receiving roll is cut and the tip of the electrophotographic image receiving sheet reaches a detection position. Then, the electrophotographic image receiving sheet is conveyed in an opposite direction and reaches the position in front of the image forming unit, then the driving unit stops and thereby causes the electrophotographic image receiving sheet to stop. Another image is then formed on the electrophotographic image receiving sheet.

It is preferred for energy saving to avoid the heating and pressing of an unnecessary portion, i.e., non-imaging area, of the electrophotographic image receiving sheet (or roll). Thus, the apparatus preferably further comprises (1) a mechanism for retracting the rollers and belt of the belt image-fixing unit or (2) a mechanism for stopping heating the heating and pressing roller, upon passing of the non-imaging area through the belt image-fixing unit.

<Other Unit>

Examples of the other unit are unit for image correction, unit for backside printing, a sorter, and a heating and pressing roller serving as a primary image-fixing unit.

The unit for image correction works to detect a finished image quality in the electrophotographic print and feed back the data of finished image quality to the unit for image processing and controlling to thereby correct the image.

Examples of the data of finished image quality are image irregularity, glossiness, surface scratches and stain.

Examples of the detection unit are a line sensor camera, a CCD camera, a CMOS sensor and visual observation.

The unit for image correction can be any suitable one according to the purpose, and examples thereof are color space conversion, automatic white balance and exposure control, density correction, and color gradation correction. Each of these can be carried out alone or in combination.

Detailed examples of the unit for image correction can be found in JP-A No. 2000-152017, No. 2000-101860 and No. 11-198452.

The unit for backside printing works to print information on the backside (a side which does not have the toner-image receiving layer) of one selected from the electrophotographic image receiving roll, electrophotographic image receiving sheet, electrophotographic print and series of electrophotographic prints. Examples of the information are a frame number, customer number, customer name, file name, sheet number, logo, price, performance, catch phrase, company name, trade name (product name), trade mark, diagram, picture, pattern, image information (exchangeable image file format information; Exif information), information on the copyright of the image, name of a photographic machine used, information on a photographer, and information on image processing.

The printing unit can be any suitable one according to the purpose, and examples thereof are a line printer, a page printer and other printing devices.

The unit for backside printing can be arranged at any position of the apparatus, except for a region between the image forming unit and the image-fixing area.

The sorter 116 is arranged at the downstream-most part of the image forming apparatus (FIGS. 1 and 2), has one to ten trays for sorting the electrophotographic prints with the image formed and can efficiently sort a large quantity of the electrophotographic prints.

The sorter can be any suitable one according to the purpose. The sorter preferably has at least one function selected from a function of sorting the prints based on the customers, a function of sorting the prints based on the ordered information of the customers, a function of sorting the prints based on the sizes of sheets, a function of sorting the prints based on the types of sheets, and a function of sorting the prints based on the frame numbers or file numbers in order with a mechanism for conveying plural plies of the prints in parallel in a direction perpendicular to the conveying direction.

Image Forming System

The mage forming system of the present invention comprises the image forming apparatus of the present invention, unit for feeding information from a user to the image forming apparatus, and unit for billing the user depending on the amount of usage and may further comprise one or more other units according to necessity.

The unit for feeding information from a user works to feed the user information to the image forming apparatus. The unit for feeding information from a user is preferably one selected from an information input terminal (touch panel monitor), mobile data terminal, phone line and network.

Examples of the information to be inputted are customer information, date, state of the print surface (glossy, matte or embossed surface), number of prints to be treated, size of the prints (L size (89 mm times 127 mm), A6 size (105 mm times 150 mm), A4 size (210 mm times 300 mm), B4 size, A3 size, B5 size, postal-card size, and business-card size), type of the original, and magnification of the print.

The billing unit works to bill the user depending on the amount of usage and can be, for example, a "coin kit" or a bill receiving machine.

The image forming system is placed at the store front of, for example, photo shops, convenience stores, copy centers, and stationery stores and efficiently and conveniently provides high-quality electrophotographic prints that are equal to silver-halide photographic prints. In addition, the image forming system is of dry system which does not require liquid management and achieves space and power savings.

Electrophotographic Print

The electrophotographic prints of the present invention can be produced by the image forming apparatus of the present invention.

The electrophotographic prints have a 45-degree glossiness of preferably 85 or more, more preferably 90 or more and further preferably 95 or more as determined by a method specified in Japanese Industrial Standards (JIS) Z8741.

The electrophotographic prints of the present invention can be borderless prints equivalent to silver-halide photographic prints. They have high image quality equivalent to silver-halide photographs, in which the hardware such as the medium (electrophotographic image receiving sheet), the printer (image forming apparatus) and the unit for aftertreatment (including image smoothing and fixing) optimally matches with the toner.

The present invention will be illustrated in further detail with reference to several examples below, which are not intended to limit the scope of the present invention.

EXAMPLE 1

Preparation of Support

A band of woodfree paper having a basis weight of 160 g/m$^2$ was used as a raw paper. A 7:3 (by weight) mixture of a high density polyethylene (HDPE) and a low density polyethylene (LDPE) was extruded and applied at 310° C. onto a backside of the raw paper to thereby form a backside polyethylene resin layer 15 μm thick thereon.

Next, a low density polyethylene (LDPE) was extruded at 310° C. and applied onto a front side of the raw paper to thereby form a front-side polyethylene resin layer 31.7 μm thick thereon.

Thus, a band of double-sided polyethylene resin coated support was prepared. The optical transmittance of the support was determined with a direct-reading haze meter HGM-2DP (trade name, available from Suga Test Instruments, Japan) and was found to be 12.1%.

Preparation of Coating Liquid for Interlayer

A coating liquid for interlayer was prepared by mixing and blending the following components.

| | |
|---|---|
| Acrylic resin dispersion (solid content 45% by weight, HE-1335, Seiko Chemical Industries Co., Ltd.) | 100.0 g |
| Thickening agent (Alkox R-1000, Meisei Chemical Works, Ltd.) | 1.0 g |
| Anionic surfactant (AOT) | 0.6 g |
| Ion-exchanged water | 34.0 g |

The above-prepared coating liquid for interlayer has a viscosity of 70 mPa·s and a surface tension of 33 mN/m.

Preparation of Coating Liquid for Toner-image Receiving Layer

<Titanium Dioxide Dispersion>

A titanium dioxide dispersion containing 40% by weight of a titanium dioxide pigment was prepared by mixing and dispersing the following components using a kneader NBK-2 available from Nihon Seiki Seisakusho Co., Ltd., Japan.

| | |
|---|---|
| Titanium dioxide (TIPAQUE (registered trademark) R-780-2, Ishihara Sangyo Kaisha, Ltd.) | 40.0 g |
| Poly(vinyl alcohol) (PVA 205, Kuraray Co., Ltd.) | 5.0 g |
| Ion-exchanged water | 55.0 g |

<Coating Liquid for Toner-image Receiving Layer>

A coating liquid for toner-image receiving layer was prepared by mixing and blending the following components.

| | |
|---|---|
| Above-prepared titanium dioxide dispersion | 15.5 g |
| Carnauba wax dispersion (SELOSOL 524, Chukyo Yushi Co., Ltd.) | 20.0 g |
| Aqueous dispersion of polyester resin (solid content 30% by weight, KZA-7049, Unitika Ltd.) | 200.0 g |
| Thickening agent (Alkox R-1000, Meisei Chemical Works, Ltd.) | 8.0 g |
| Anionic surfactant (AOT) | 1.6 g |
| Ion-exchanged water | 100.0 g |

The above-prepared coating liquid for toner-image receiving layer contains 21% by weight of titanium dioxide with respect to the polyester resin and has a viscosity of 70 mPa·s and a surface tension of 29 mN/m.

Application of Toner-image Receiving Layer and Interlayer

The coating liquid for interlayer and the coating liquid for toner-image receiving layer were sequentially applied to the front side of the band of support using a bar coater.

These coating liquids were applied to form an interlayer having a dry weight of 5.0 g/m$^2$ and a toner-image receiving layer having a dry weight of 5.5 g/m$^2$.

The applied interlayer and toner-image receiving layer were dried with hot air on line. The volume of hot air and temperature in drying were controlled so that the surfaces of the interlayer and toner-image receiving layer were dried within two minutes from the application. The endpoint of drying was set such that the surface temperature of the applied layer became equal to the wet-bulb temperature of the hot air. Thus, a band of sheet was prepared. The band of sheet was cut into a slit 148 mm wide to thereby yield a roll of electrophotographic image receiving sheet (electrophotographic image receiving roll) according to Example 1.

A photographic image was printed on the above-prepared electrophotographic image receiving roll using the electrophotographic image forming apparatus shown in FIG. 3. The image forming apparatus used herein was an image forming apparatus DocuCentre Color 500 (trade name, available from Fuji Xerox Co., Ltd., Japan), except for having a roll feeding unit and roll cutting unit instead of the original paper feeding unit and having an image smoothing and fixing unit shown in FIG. 5 instead of the original image-fixing unit to carry out smoothing and glossing-over procedure. The image forming apparatus further had a print border cutting unit (X-Y cutter) downstream from the image smoothing and fixing unit.

As the photographic image, a portrait image was taken with a digital still camera (DSC) and was printed to a width of 137 mm and a height of 188 mm on the roll. The print border cutting unit was set so as to cut the series of prints into prints 127 mm in a width direction and 178 mm in a conveying direction. Thus, "2L-sized" borderless photographic prints were prepared.

Hot-pressing (Heating and Pressing)

The hot-pressing procedure was carried out using a pair of a heating roller and a pressing roller. The heating roller had a diameter of 50 mm and was heated at 130° C. by the action of an internal heater. The pressing roller had a diameter of 50 mm and was heated at 125° C. by the action of an internal heater.

Belt

The belt used herein had a support and a release layer. The support was a polyimide (PI) film 50 cm wide and 80 μm thick. The release layer was a film of fluorocarbonsiloxane rubber 50 μm thick prepared by curing a precursor of fluorocarbonsiloxane rubber, SIFEL 610 (Shin-Etsu Chemical Co. Ltd., Japan).

Cooling Process

The cooling process was carried out at a conveying rate of 53 mm/sec using a cooling device having a heatsink length of 80 mm.

EXAMPLE 2

A roll of electrophotographic image receiving sheet was prepared by the procedure of Example 1, except that the toner-image receiving layer was not formed.

A photographic image was printed on the prepared electrophotographic image receiving roll using the image forming apparatus shown in FIG. 3 under the following conditions. Using an image smoothing and fixing unit capable of feeding a transparent toner shown in FIG. 6, a transparent toner having an average particle diameter of 10 μm was uniformly fed to a portion of the belt facing the toner image in an amount of 10 g/m$^2$ to thereby smooth and gloss over the image. Thus, an electrophotographic print was prepared.

COMPARATIVE EXAMPLE 1

An electrophotographic print was prepared by the procedure of Example 1, except for using the electrophotographic image receiving sheet having no toner-image receiving layer prepared according to Example 2.

COMPARATIVE EXAMPLE 2

The electrophotographic image receiving roll prepared according to Example 1 was cut into electrophotographic image receiving sheets 127 mm wide and 178 mm long.

The above-prepared electrophotographic image receiving sheets were set into a cassette tray of an image forming apparatus DocuCentre Color 500 (trade name, available from Fuji Xerox Co., Ltd., Japan), and a photographic image was printed thereon by the procedure of Example 1. The resulting electrophotographic print had a margin about 4 mm wide on its periphery.

COMPARATIVE EXAMPLE 3

The electrophotographic image receiving sheet roll prepared according to Example 1 was cut into electrophotographic image receiving sheets 127 mm wide and 178 mm long.

A photographic image was printed on the above-prepared electrophotographic image receiving sheets by the procedure of Example 1 using an image forming apparatus. The image forming apparatus used herein was an image forming apparatus DocuCentre Color 500 (trade name, available from Fuji Xerox Co., Ltd., Japan) except for replacing its original image-fixing unit with the image smoothing and fixing unit shown in FIG. 5. The resulting electrophotographic print had a margin about 4 mm wide on its periphery.

REFERENCE EXAMPLE 1

A photographic image as above was printed using a silver-halide photographic printer Frontier 350 (trade name, available from Fuji Photo Film Co., Ltd., Japan) to thereby yield a borderless silver-halide photographic print 127 mm wide and 178 mm long.

The 45-degrees glossiness and sensory quality of the respective prints were determined in the following manner. The results are shown in Table 3.

<45-Degree Glossiness>

The 45-degree glossiness of the respective prints was determined according to JIS Z8741.

<Sensory Photographic Image Quality>

In the following sensory tests, rating was performed according to the following criteria and was expressed as an average of 20 persons' rating, who are relatively excellently capable of rating image quality of photographs. The result is shown in average.

5: Very desirable
4: Desirable
3: Medium
2: Undesirable
1: Very undesirable

TABLE 3

| | | Glossiness | Margin of image | Sensory test |
|---|---|---|---|---|
| Ex. 1 | Electrophotograph | 95 | no | 4.2 |
| Ex. 2 | Electrophotograph | 98 | no | 4.2 |
| Com. Ex. 1 | Electrophotograph | 68 | no | 1.8 |
| Com. Ex. 2 | Electrophotograph | 51 | yes | 2.0 |
| Com. Ex. 3 | Electrophotograph | 95 | yes | 3.2 |
| Ref. Ex. 1 | Silver-halide photograph | 95 | no | 4.4 |

The present invention provides an electrophotographic image forming apparatus that can produce high-quality electrophotographic prints equal to silver-halide photographs. In the apparatus, the hardware (such as the medium (electrophotographic image receiving sheet), the printer (image forming apparatus) and the unit for aftertreatment (including image smoothing and fixing)) optimally matches with the toner. It also provides an image forming system of dry system which does not require treatment of a developing solution, fixing solution, water and waste liquids thereof and achieves space and power savings.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a forming unit configured to form a latent electrostatic image on a latent electrostatic image bearing member based on information on a digital image;

a developing unit configured to develop the latent electrostatic image with a toner to thereby form a visible image;

a transferring unit configured to transfer the visible image to one of an electrophotographic image receiving roll and an electrophotographic image receiving sheet; and a smoothing and fixing unit configured to smooth and fix the transferred image on the one of the electrophotographic image receiving roll and the electrophotographic image receiving sheet, to thereby form one of a series of electrophotographic prints and an electrophotographic print, wherein the one of the electrophotographic image receiving roll and the electrophotographic image receiving sheet comprises:

a support and at least one toner-image receiving layer comprising a thermoplastic resin on or above the support, and the support comprises a raw paper and a thermoplastic resin layer which is arranged on at least one side of the raw paper, and wherein the smoothing and fixing unit comprises:

a belt member, a pair of pressing members configured to interpose the belt member therebetween so as to form a nip and configured to contact the surface of the belt member with the one of the electrophotographic image receiving roll and the electrophotographic image receiving sheet so that the transferred image faces the belt member, a heating member configured to heat the belt and the one of the electrophotographic image receiving roll and the electrophotographic image receiving sheet passing through the nip so that the transferred image is fused and thereby fixed on the one of the electrophotographic image receiving roll and the electrophotographic image receiving sheet, and a cooling member configured to cool the one of the electrophotographic image receiving roll and the electrophotographic image receiving sheet being contacted with the surface of the belt member.

2. The image forming apparatus according to claim 1, further comprising a cutting unit configured to cut the electrophotographic image receiving roll into the electrophotographic image receiving sheets having a specific size.

3. The image forming apparatus according to claim 1, further comprising a cutting unit configured to cut the series of the electrophotographic prints into the electrophotographic prints having a specific size.

4. The image forming apparatus according to claim 1, further comprising a removing unit configured to remove a peripheral margin in a peripheral section of the electrophotographic print, the peripheral margin being free from a formation of the image of the toner.

5. The image forming apparatus according to claim 4, wherein the removing unit is so configured as to remove the peripheral margin in longitudinal and transverse directions of the electrophotographic print.

6. The image forming apparatus according to claim 1, further comprising a rewinding unit configured to rewind the electrophotographic image receiving roll after cutting the series of the electrophotographic prints for another use.

7. The image forming apparatus according to claim 1, further comprising a processing and controlling unit configured to process and control the image, the processing and controlling unit working to capture inputted image data as digital image data, processing the digital image data and controlling an output from the processed digital image data to thereby form the information on the digital image.

8. The image forming apparatus according to claim 7, wherein the inputted image data is at least one selected from the group consisting of (1) image data read out from a film image using a film scanner, the film image being taken with a film camera; (2) processed image data derived from photographed image data; (3) image data photographed with a digital still camera; (4) image data captured from one of a digital video camera and a recorder; and (5) image data read out from a reflection copy with a reflection scanner.

9. The image forming apparatus according to claim 7, wherein the apparatus is so configured to process the image and control the image output using at least one selected from the group consisting of (1) a device capable of capturing arbitrary image data from a portable memory on which the image data are recorded, (2) a device capable of accessing a network and capable of capturing accumulated image data from a server connected to the network, (3) a device capable of scanning an analogue image and capturing the analogue image as a digital image, (4) a device capable of connecting to a mobile data terminal and capable of capturing image data in the mobile data terminal, (5) a device capable of selectively carrying out an arbitrary additional image processing, (6) a device distinguishing between a character and a picture and performing a specific image processing, and (7) a device using a three-dimensional look-up table.

10. The image forming apparatus according to claim 7, further comprising a correcting unit configured to correct the image, the correcting unit detecting a finished image quality of the electrophotographic print and feeding back the data of finished image quality to the processing and controlling unit, to thereby correct the image.

11. The image forming apparatus according to claim 1, wherein the apparatus is so configured as to apply a transparent toner comprising a thermoplastic resin to the visible image on the one of the electrophotographic image receiving roll and the electrophotographic image receiving sheet, and heat, pressurize and cool the visible image covered with a transparent toner layer and then peel off the one of the electrophotographic image receiving sheet and the electrophotographic image receiving roll using the image smoothing and fixing unit.

12. The image forming apparatus according to claim 1, wherein the apparatus is so configured as to develop a transparent toner image and the visible image by the developing unit using a transparent toner comprising a thermoplastic resin and using a color toner, transfer the visible image to the one of the electrophotographic image receiving roll and the electrophotographic image receiving sheet by the transferring unit, and transfer the transparent toner image onto the visible image at least one of simultaneously with and after the transferring of the visible image.

13. The image forming apparatus according to claim 1, wherein the belt member comprises on a surface thereof a fluorocarbonsiloxane rubber layer.

14. The image forming apparatus according to claim 13, wherein a fluorocarbonsiloxane rubber in the fluorocarbonsiloxane rubber layer comprises in a principal chain thereof at least one of a perfluoroalkyl ether group and a perfluoroalkyl group.

15. The image forming apparatus according to claim 1, wherein the belt member comprises on a surface thereof a silicone rubber layer and a fluorocarbonsiloxane layer on the silicone rubber layer.

16. The image forming apparatus according to claim 15, wherein a fluorocarbonsiloxane rubber in the fluorocarbonsiloxane rubber layer comprises in a principal chain thereof at least one of a perfluoroalkyl ether group and a perfluoroalkyl group.

17. The image forming apparatus according to claim 1, further comprising a backface printing unit configured to print information on a side free from the toner-image receiving layer, the side being of at least one selected from the group consisting of the electrophotographic image receiving roll, the electrophotographic image receiving sheet, the electrophotographic print and the series of the electrophotographic prints.

18. The image forming apparatus according to claim 17, wherein the information is at least one selected from the group consisting of a frame number, a customer number, a customer name, a file name, a sheet number, a logo, a price, a performance, a catch phrase, a company name, a trade name, a trade mark, a diagram, a picture, a pattern, image information which is exchangeable image file format information, information on a copyright of the image, a name of a photographic machine, information on a photographer, and information on image processing.

19. The image forming system according to claim 17, wherein the feeding unit is at least one selected from the group consisting of an information input terminal, a mobile data terminal, an electronic mail, a telephone line and a network.

20. The image forming apparatus according to claim 1, wherein the heating member is provided in at least one of the pressing members.

21. The image forming apparatus according to claim 1, wherein the belt member is an endless belt, the pressing members are rollers, and the heating member is a heater.

22. The image forming apparatus according to claim 1, wherein the belt member has a surface roughness of 20 μm or less.

23. An image forming system comprising:

an image forming apparatus;

a feeding unit configured to feed information from a user to the image forming apparatus; and a billing unit configured to bill the user depending on an amount of usage, wherein the image forming apparatus comprises:

a forming unit configured to form a latent electrostatic image on a latent electrostatic image bearing member based on information on a digital image;

a developing unit configured to develop the latent electrostatic image with a toner to thereby form a visible image;

a transferring unit configured to transfer the visible image to one of an electrophotographic image receiving roll and an electrophotographic image receiving sheet; and a smoothing and fixing unit configured to smooth and fix the transferred image on the one of the electrophotographic image receiving roll and the electrophotographic image receiving sheet, to thereby form one of a series of electrophotographic prints and an electrophotographic print, wherein the smoothing and fixing unit comprises:

a belt member, a pair of pressing members configured to interpose the belt member therebetween so as to form a nip and configured to contact the surface of the belt member with the one of the electrophotographic image receiving roll and the electrophotographic image receiving sheet so that the transferred image faces the belt member, a heating member configured to heat the belt and the one of the electrophotographic image receiving roll and the electrophotographic image receiving sheet passing through the nip so that the transferred image is fuse and thereby fixed on the one of the electrophotographic image receiving roll and the electrophotographic image receiving sheet, and a cooling member configured to cool the one of the electrophotographic image receiving roll and the electrophotographic image receiving sheet being contacted with the surface of the belt member.

24. The image forming system according to claim 23, further comprising a processing and controlling unit configured to process and control the image, the processing and controlling unit working to capture inputted image data as digital image data, processing the digital image data and controlling an output from the processed digital image data to thereby form the informalion on the digital image.

25. An electrophotographic print formed by an image forming system, the image forming system comprising:

an image forming apparatus;

a feeding unit configured to feed information from a user to the image forming apparatus; and a billing unit configured to bill the user depending on an amount of usage, wherein the image forming apparatus comprises;

a forming unit configured to form a latent electrostatic image on a latent electrostatic image bearing member based on information on a digital image;

a developing unit configured to develop the latent electrostatic image with a toner to thereby form a visible image;

a transferring unit configured to transfer the visible image to one of an electrophotographic image receiving roll and an electrophotographic image receiving sheet; and a smoothing and fixing unit configured to smooth and fix the transferred image on the one of the electrophotographic image receiving roll and the electrophotographic image receiving sheet, to thereby form one of a series of electrophotographic prints and an electrophotographic print, wherein the smoothing and fixing unit comprises:

a belt member, a pair of pressing members configured to interpose the belt member therebetween so as to form a nip and configured to contact the surface of the belt member with the one of the electrophotographic image receiving roll and the electrophotographic image receiving sheet so that the transferred image faces the belt member, a heating member configured to heat the belt and the one of the electrophotographic image receiving roll and the electrophotographic image receiving sheet passing through the nip so that the transferred image is fuse and thereby fixed on the one of the electrophotographic image receiving roll and the electrophotographic image receiving sheet, and a cooling member configured to cool the one of the electrophotographic image receiving roll and the electrophotographic image receiving sheet being contacted with the surface of the belt member.

26. The electrophotographic print according to claim 25, further comprising a processing and controlling unit configured to process and control the image, the processing and controlling unit working to capture inputted image data as digital image data, processing the digital image data and controlling an output from the processed digital image data to thereby form the information on the digital image.

27. The electrophotographic print according to claim 25, which has a 45-degree glossiness of 85 or more as determined according to a method specified in Japanese Industrial Standards Z8741.

28. The electrophotographic print according to claim 25, wherein the image of the toner is formed on substantially an entire surface of the electrophotographic print.

* * * * *